US011767188B2

(12) United States Patent
Shimada

(10) Patent No.: US 11,767,188 B2
(45) Date of Patent: Sep. 26, 2023

(54) MEDIUM CONVEYING APPARATUS IN WHICH REFLECTIVITY IN PERIPHERY OF OPENING FOR GUIDING LIGHT IS EQUAL TO OR LESS THAN PREDETERMINED RATIO

(71) Applicant: PFU LIMITED, Kahoku (JP)

(72) Inventor: Tomoki Shimada, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 17/450,249

(22) Filed: Oct. 7, 2021

(65) Prior Publication Data

US 2022/0169464 A1 Jun. 2, 2022

(30) Foreign Application Priority Data

Nov. 30, 2020 (JP) ..... 2020-198499

(51) Int. Cl.

| | |
|---|---|
| ***B65H 7/14*** | (2006.01) |
| ***B65H 7/20*** | (2006.01) |
| ***B65H 7/06*** | (2006.01) |
| ***B65H 9/00*** | (2006.01) |

(52) U.S. Cl.

CPC ..... *B65H 7/14* (2013.01); *B65H 7/20* (2013.01); *B65H 9/002* (2013.01); *B65H 2553/44* (2013.01)

(58) Field of Classification Search

CPC ... B65H 7/14; B65H 7/20; B65H 7/02; B65H 7/06; B65H 7/10; B65H 9/002; B65H 9/20; B65H 2553/44; B65H 2553/412; B65H 2553/416; B65H 2553/414

See application file for complete search history.

(56) References Cited

U.S. PATENT DOCUMENTS

| | | | | |
|---|---|---|---|---|
| 2018/0220022 | A1* | 8/2018 | Yoshikaie | H04N 1/00755 |
| 2020/0177752 | A1* | 6/2020 | Shiota | H04N 1/00737 |
| 2021/0037156 | A1* | 2/2021 | Tamura | H04N 1/00734 |
| 2022/0017319 | A1* | 1/2022 | Machii | G03G 15/5029 |

FOREIGN PATENT DOCUMENTS

| | | | |
|---|---|---|---|
| JP | 2016-183863 | A | 10/2016 |
| JP | 2017095228 | A * | 6/2017 |
| JP | 2018132955 | A * | 8/2018 |
| JP | 2018-157448 | A | 10/2018 |

* cited by examiner

*Primary Examiner* — Luis A Gonzalez
(74) *Attorney, Agent, or Firm* — LEWIS ROCA ROTHGERBER CHRISTIE LLP

(57) ABSTRACT

A medium conveying apparatus conveyable a passport includes a guide pair including a first guide, and a second guide located so as to sandwich a medium conveyance path together with the first guide, to regulate a vertical direction of the medium conveyance path, a light emitting element located on an outside of the medium conveyance path with one of the first guide or the second guide in between to detect the medium, a light receiving element located on an outside of the medium conveyance path with the first guide in between, to receive a light emitted by the light emitting element, and an opening provided in the first guide, to pass the light emitted from the light emitting element. A reflectivity in a periphery of the opening of the first guide is 55% or less.

6 Claims, 23 Drawing Sheets

MEDIUM CONVEYING APPARATUS IN WHICH REFLECTIVITY IN PERIPHERY OF OPENING FOR GUIDING LIGHT IS EQUAL TO OR LESS THAN PREDETERMINED RATIO

CROSS-REFERENCE TO RELATED APPLICATIONS

This application is based upon and claims the benefit of priority of prior Japanese Patent Application No. 2020-198499, filed on Nov. 30, 2020, the entire contents of which are incorporated herein by reference.

TECHNICAL FIELD

Embodiments discussed in the present specification relate to medium conveyance.

BACKGROUND

In a medium conveying apparatus such as a scanner to image and convey a medium needs to correctly detect a state of the medium during conveyance in order to appropriately control the conveyance of the medium. In such a medium conveying apparatus, for example, a light emitting element and a light receiving element are provided in the vicinity of a medium conveyance path to detect the medium based on an intensity of light received by the light receiving element.

An optical sensor including a sensitive portion for changing a refractive index in response to a substance in a fluid, a light emitting element for irradiating light to the sensitive portion, and a light receiving element for receiving reflected light at the sensitive portion, is disclosed (see Japanese Unexamined Patent Application Publication (Kokai) No. 2016-183863). The optical sensor detects the substance by a change in a light intensity of the reflected light according to a change in the refractive index of the sensitive portion.

A sheet end portion detection apparatus including a light emitting portion for irradiating light to a conveyed sheet, and a light receiving portion located at a position of one side end portion in a direction perpendicular to a paper conveying direction, for receiving light from the light emitting portion, is disclosed (see Japanese Unexamined Patent Application Publication (Kokai) No. 2018-157448). The sheet end portion detection apparatus detects the position of the end portion by an amount of the light received by the light receiving portion.

SUMMARY

According to some embodiments, a medium conveying apparatus conveyable a passport includes a guide pair including a first guide, and a second guide located so as to sandwich a medium conveyance path together with the first guide, to regulate a vertical direction of the medium conveyance path, a light emitting element located on an outside of the medium conveyance path with one of the first guide or the second guide in between to detect the medium, a light receiving element located on an outside of the medium conveyance path with the first guide in between, to receive a light emitted by the light emitting element, and an opening provided in the first guide, to pass the light emitted from the light emitting element. A reflectivity in a periphery of the opening of the first guide is 55% or less.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
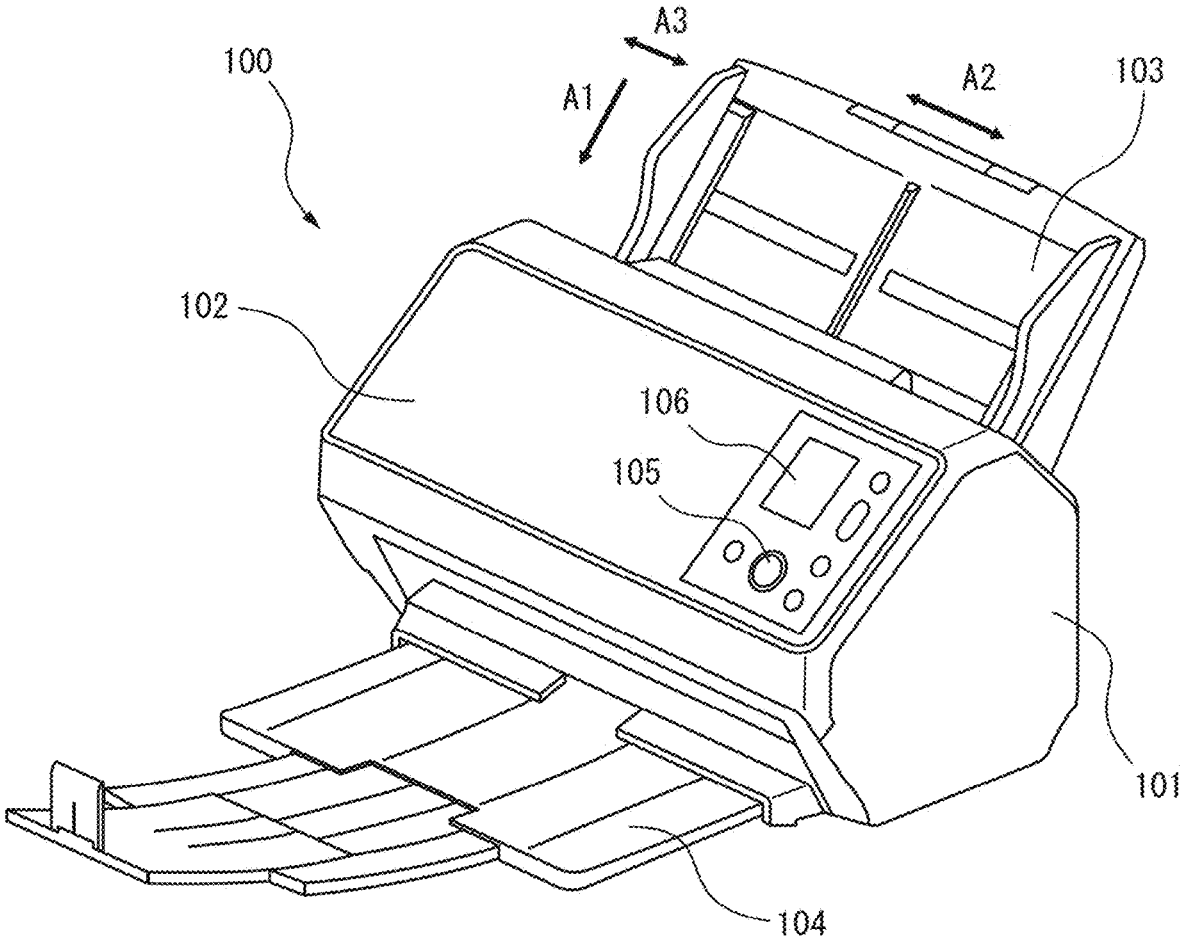
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. A medium is a paper, a thin paper, a thick paper, a card, a brochure, a passport, etc. The medium also includes a transparent carrier sheet to sandwich a paper in order to convey the paper in two folds or protect the paper. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106. An arrow A1 in FIG. 1 indicates a medium conveying direction. Hereinafter, an upstream refers to an upstream in the medium conveying direction A1, and a downstream refers to a downstream in the medium conveying direction A1. An arrow A2 indicates a width direction perpendicular to the medium conveying direction A1. An arrow A3 indicates a vertical direction perpendicular to a medium conveying surface.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc. The medium tray 103 is engaged with the lower housing 101 in such a way as to be able to place a medium to be conveyed. The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
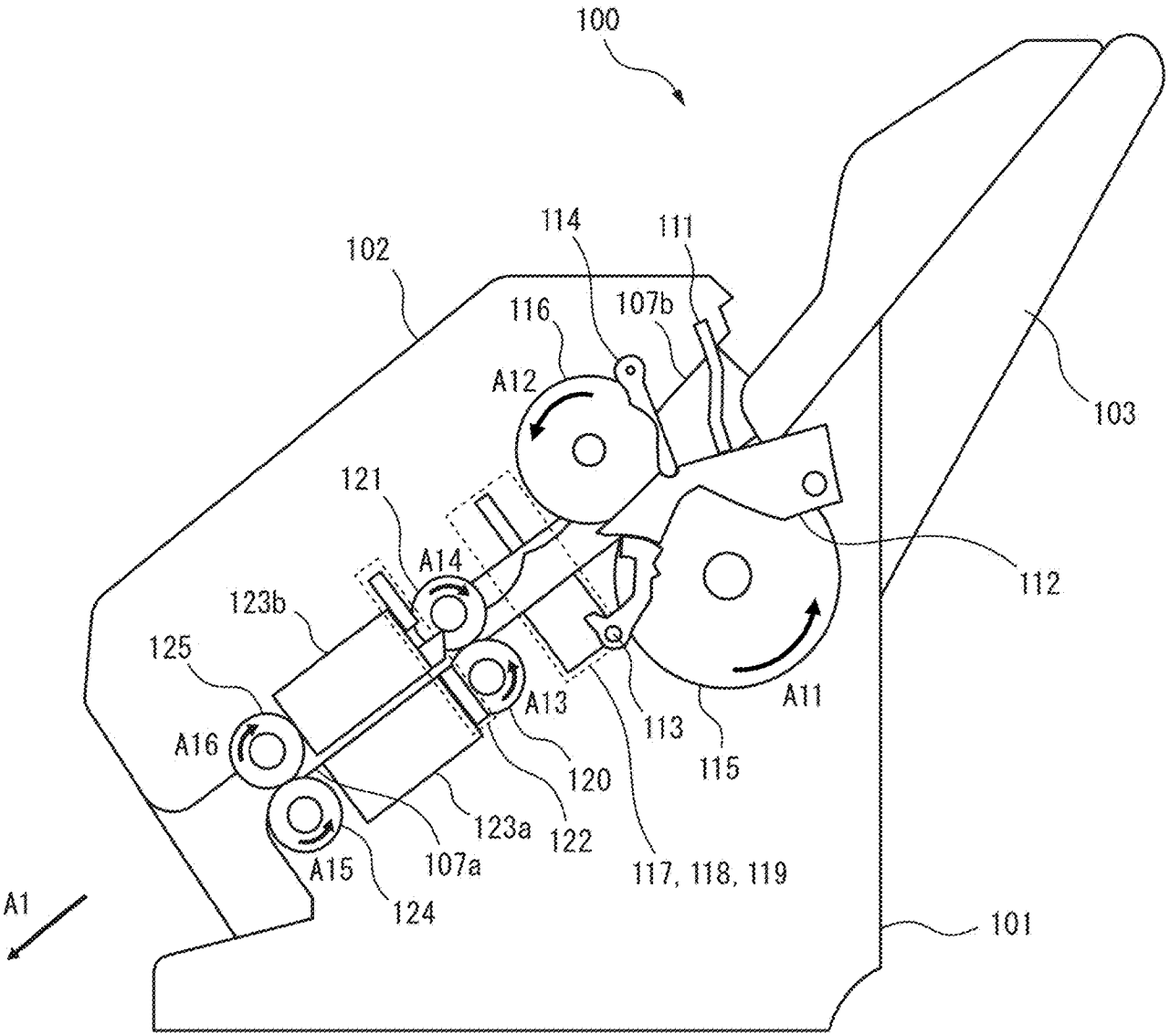
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes a medium sensor 111, a set guide 112, a moving mechanism 113, a flap 114, a feed roller 115, a brake roller 116, a first sensor 117, a second sensor 118, a third sensor 119, a first conveying roller 120, a second conveying roller 121, a fourth sensor 122, a first imaging device 123*a*, a second imaging device 123*b*, a third conveying roller 124 and a fourth conveying roller 125, etc. The number of each roller is not limited to one, and may be plural.

A top surface of the lower housing 101 forms a lower guide 107*a* of a medium conveyance path, and a bottom surface of the upper housing 102 forms an upper guide 107*b* of the medium conveyance path. The lower guide 107*a* is an example of a first guide, and guides a lower surface of the conveyed medium. The upper guide 107*b* is an example of a second guide, and is located so as to sandwich the medium conveyance path together with the lower guide 107*a*, and guides an upper surface of the conveyed medium. The lower guide 107*a* and the upper guide 107*b* are an example of a guide pair, and regulate the vertical direction of the medium conveyance path. The lower guide 107*a* and the upper guide 107*b* are located so as to be apart from each other by a predetermined distance or more. The predetermined distance is sufficiently conveyable length of a passport having a thickness of about 5 mm, and is defined in a range of 7 mm or more and 20 mm or less. In this manner, the lower guide 107*a* and the upper guide 107*b* are provided so as to convey a passport as a medium.

The medium sensor 111 is located on an upstream side of the feed roller 115 and the brake roller 116. The medium sensor 111 includes a contact detection sensor, and detects whether or not the medium is placed on the medium tray 103. The medium sensor 111 generates and outputs a medium signal whose signal value changes in a state where the medium is placed on the medium tray 103 and a state where it is not placed.

The feed roller 115 is provided on the lower housing 101, and sequentially feeds the media placed on the medium tray 103 and set on the set guide 112 from the lower side. The brake roller 116 is provided on the upper housing 102, and located to face the feed roller 115.

The first conveying roller 120 and the second conveying roller 121 are provided on the downstream side of the feed roller 115 and the brake roller 116 and on the upstream side of the first imaging device 123*a* and the second imaging device 123*b* in the medium conveying direction A1. The first conveying roller 120 is provided on the lower housing 101. The second conveying roller 121 is provided on the upper housing 102, to face the first conveying roller 120. The first conveying roller 120 and the second conveying roller 121 convey the medium fed by the feed roller 115 to the downstream side, that is, to the first imaging device 123*a* and the second imaging device 123*b*.

The first imaging device 123*a* includes a line sensor based on a unity-magnification optical system type contact image sensor (CIS) including an imaging element based on a complementary metal oxide semiconductor (CMOS) linearly located in a main scanning direction. Further, the first imaging device 123*a* includes a lens for forming an image on the imaging element, and an A/D converter for amplifying and analog-digital (A/D) converting an electric signal output from the imaging element. The first imaging device 123*a* generates and outputs an input image imaging a front side of a conveyed medium, in accordance with control from a processing circuit to be described later.

Similarly, the second imaging device 123*b* includes a line sensor based on a unity-magnification optical system type CIS including an imaging element based on a CMOS linearly located in a main scanning direction. Further, the secondary imaging device 123*b* includes a lens for forming an image on the imaging element, and an A/D converter for amplifying and A/D converting an electric signal output from the imaging element. The secondary imaging device 123*b* generates and outputs an input image acquired by imaging a back surface of the conveyed medium, in accordance with control from a processing circuit to be described later.

Only either of the first imaging device 123*a* and the second imaging device 123*b* may be located in the medium conveying apparatus 100 and only one side of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs. The first imaging device 123*a* and the second imaging device 123*b* may be collectively referred to as imaging devices 123.

The third conveying roller 124 and the fourth conveying roller 125 are provided on the downstream side of the first imaging device 123*a* and the second imaging device 123*b* in the medium conveying direction A1. The third conveying roller 124 is provided on the lower housing 101. The fourth conveying roller 125 is provided on the upper housing 102, to face the third conveying roller 124. The third conveying roller 124 and the fourth conveying roller 125 ejects the medium conveyed by the first conveying roller 120 and the second conveying roller 121 to the ejection tray 104.

The brake roller 116, the second conveying roller 121, the second imaging device 123*b* and the fourth conveying roller 125 are provided so as to be movable upward according to a thickness of the conveyed medium. Thus, the brake roller 116, the second conveying roller 121, the second imaging device 123*b* and the fourth conveying roller 125 are provided so as to convey a passport as a medium. That is, the medium conveying apparatus 100 is capable of conveying a passport.

A medium placed on the medium tray 103 is conveyed between the lower guide 107*a* and the upper guide 107*b* in the medium conveying direction A1 by the feed roller 115 rotating in a direction of an arrow A11 in FIG. 2, that is, a medium feeding direction. When a medium is conveyed, the brake roller 116 rotates in a direction of an arrow A12, that is, a direction opposite to the medium feeding direction. By the workings of the feed roller 115 and the brake roller 116, when a plurality of media are placed on the medium tray 103, only a medium in contact with the feed roller 115, out of the media placed on the medium tray 103, is separated. Consequently, conveyance of a medium other than the separated medium is restricted (prevention of multi-feed)

The medium is fed between the first conveying roller 114 and the second conveying roller 115 while being guided by the lower guide 107*a* and the upper guide 107*b*. The medium is fed between the first imaging device 123*a* and the second imaging device 123*b* by the first conveying roller 120 and the second conveying roller 121 rotating in directions of an arrow A13 and an arrow A14, respectively. The medium read by the imaging devices 123 is ejected on the ejection tray 104 by the third conveying roller 124 and the fourth conveying roller 121 rotating in directions of an arrow A15 and an arrow A16, respectively.

Figure 3A:
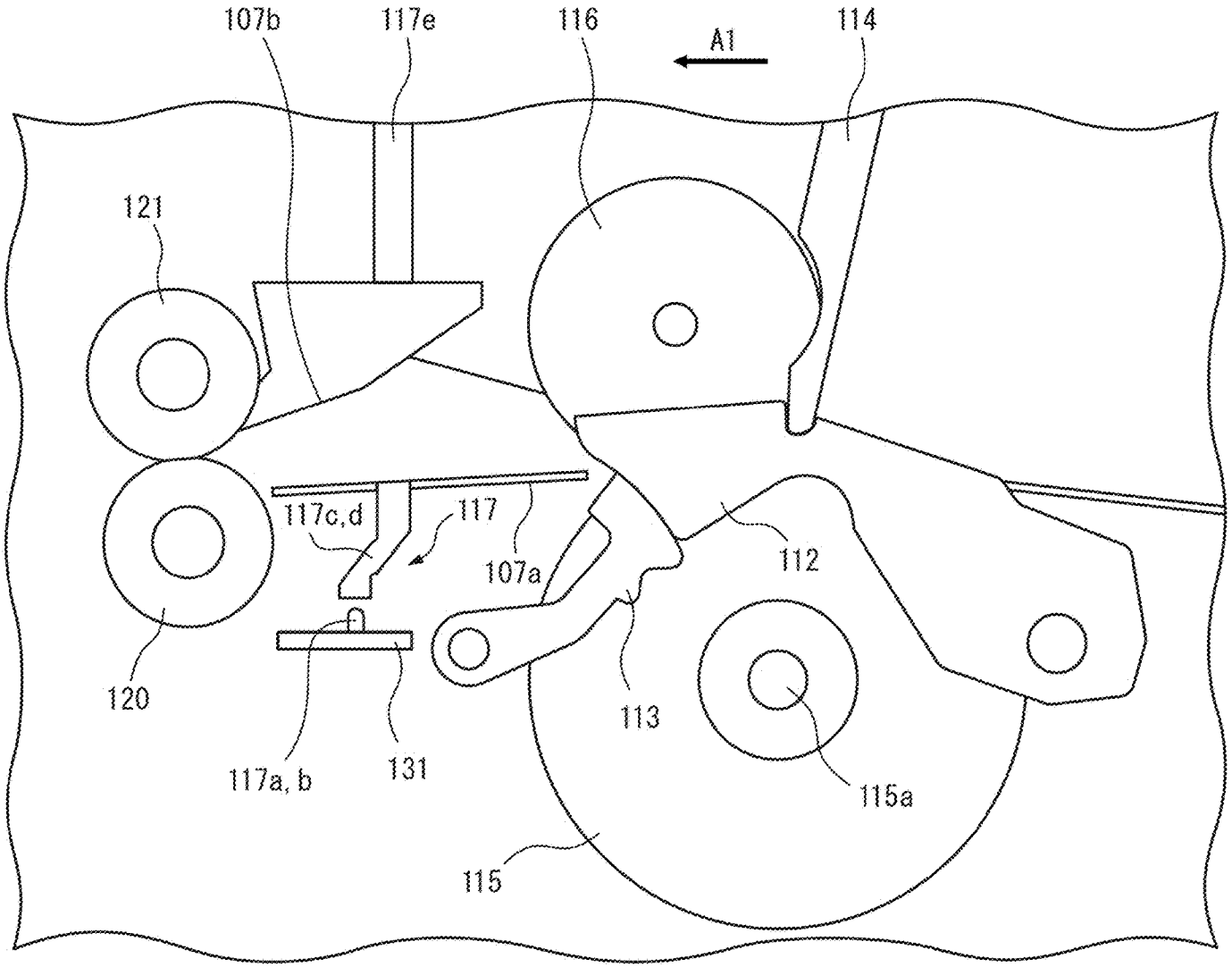
FIG. 3A is a schematic view for illustrating a set guide 112, etc.
Figure 3B:
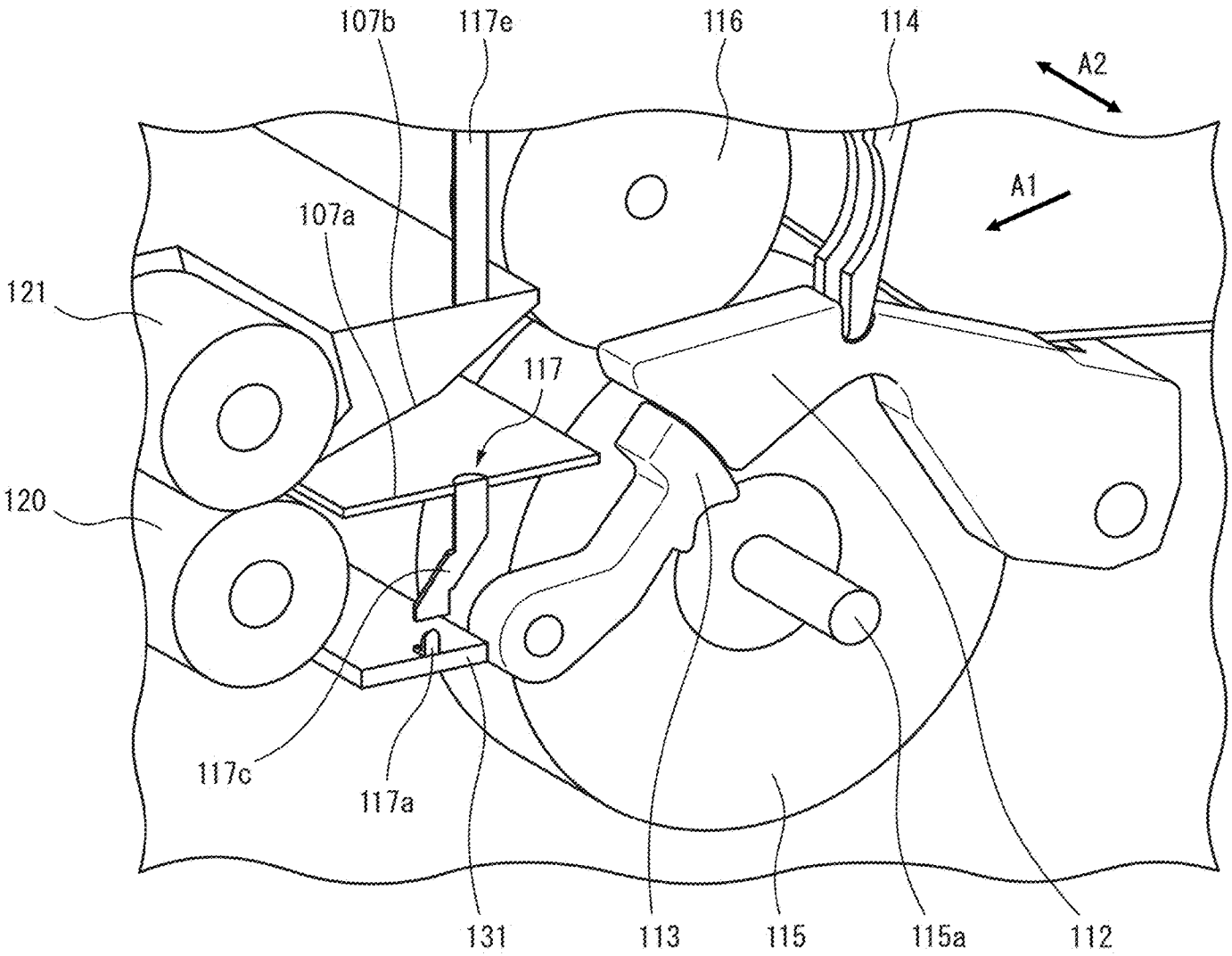
FIG. 3B is a schematic view for illustrating the set guide 112, etc.

FIG. 3A and FIG. 3B are schematic diagrams for illustrating the set guide 112, the moving mechanism 113 and the flap 114. FIG. 3A is a schematic view of the set guide 112, the moving mechanism 113 and the flap 114 before medium feeding, as viewed from the side. FIG. 3B is a schematic view illustrating a cross section acquired by cutting the medium conveyance path at a position of the first sensor 117 before medium feeding, as viewed from the downstream side and the side.

As illustrated in FIG. 3A and FIG. 3B, the set guide 112 is a guide to set the medium. The set guide 112 is located at a position facing the feed roller 115 and the brake roller 116 in the medium conveying direction A1. The set guide 112 is rotatably (swingably) supported by the lower housing 101. When the feeding of the medium is not executed, the set guide 112 supports the lower surface of the medium placed on the medium tray 103. Hereinafter, as illustrated in FIG. 3A and FIG. 3B, a position in which the set guide 112 supports the lower surface of the medium placed on the medium tray 103 may be referred to as a set position.

The moving mechanism 113 is a cam member to move the set guide 112. The moving mechanism 113 is located on the downstream side of the set guide 112 in the medium conveying direction A1. The moving mechanism 113 is located on the downstream side of a shaft 115*a* which is a rotation axis of the feed roller 115 in the medium conveying direction A1 so as not to come into contact with the shaft 115*a*. The moving mechanism 113 is supported by the lower housing 101 to be rotatable (swingable) according to a driving force from a motor to be described later. The moving mechanism 113 comes into contact with the end portion on the downstream side of the set guide 112 to hold the set guide 112 in the set position when the feeding of the medium is not executed. As illustrated in FIG. 3B, the first sensor 117 is located on the downstream side of the moving mechanism 113, and in the vicinity of the moving mechanism 113 in the medium conveying direction A1. Details of the first sensor 117 will be described later.

The flap 114 is a stopper to prevent the medium from entering a nip position of the feed roller 115 and the brake roller 116 before medium feeding. The flap 114 is located at a position facing the set guide 112 in the medium conveying direction A1. The flap 114 is provided swingably in the upper housing 102. The flap 114 engages the set guide 112 to prevent the medium from entering the nip position of the feed roller 115 and the brake roller 116 when the feeding of the medium is not executed.

Figure 4A:
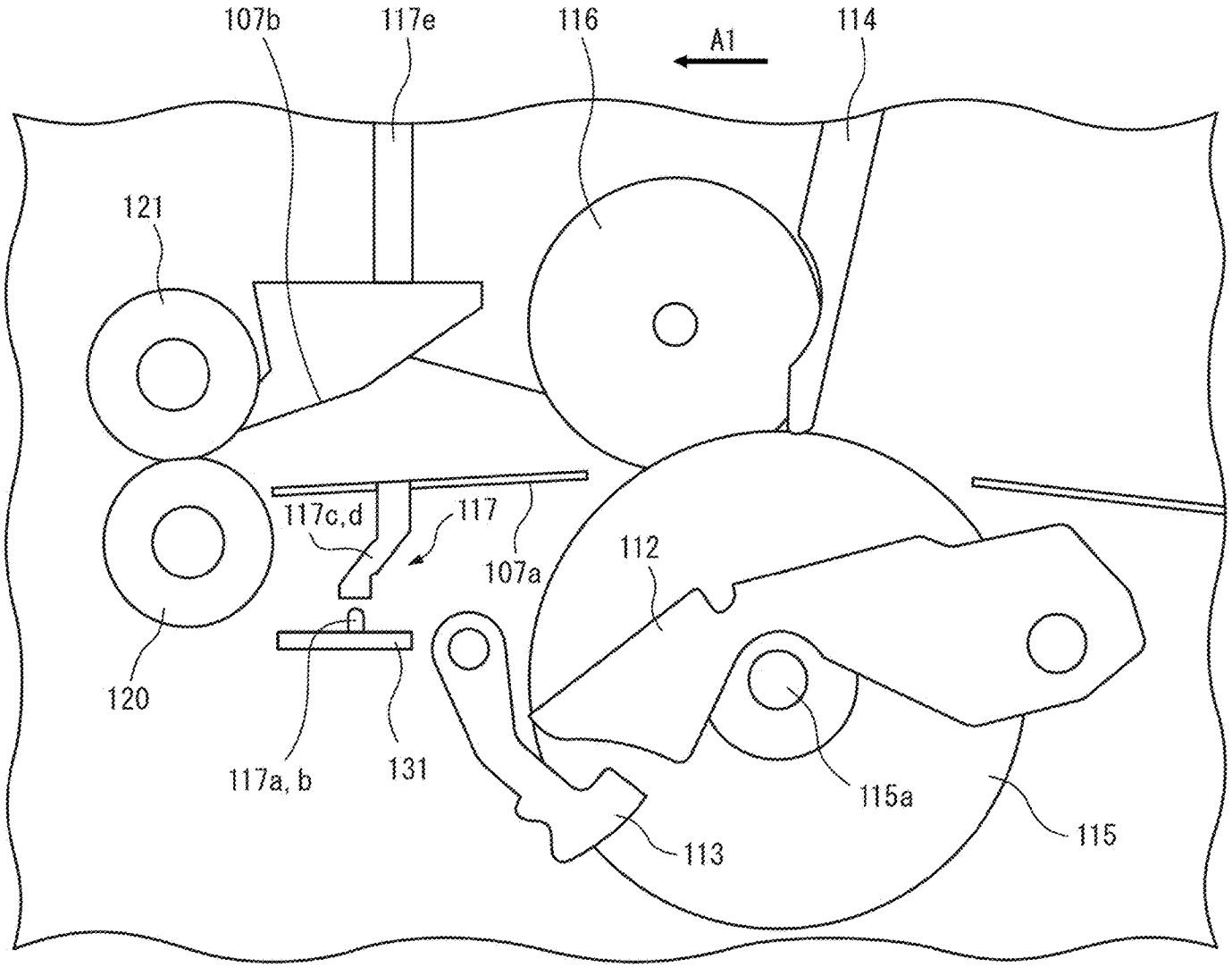
FIG. 4A is a schematic diagram for illustrating an operation of the set guide 112, etc.
Figure 4B:
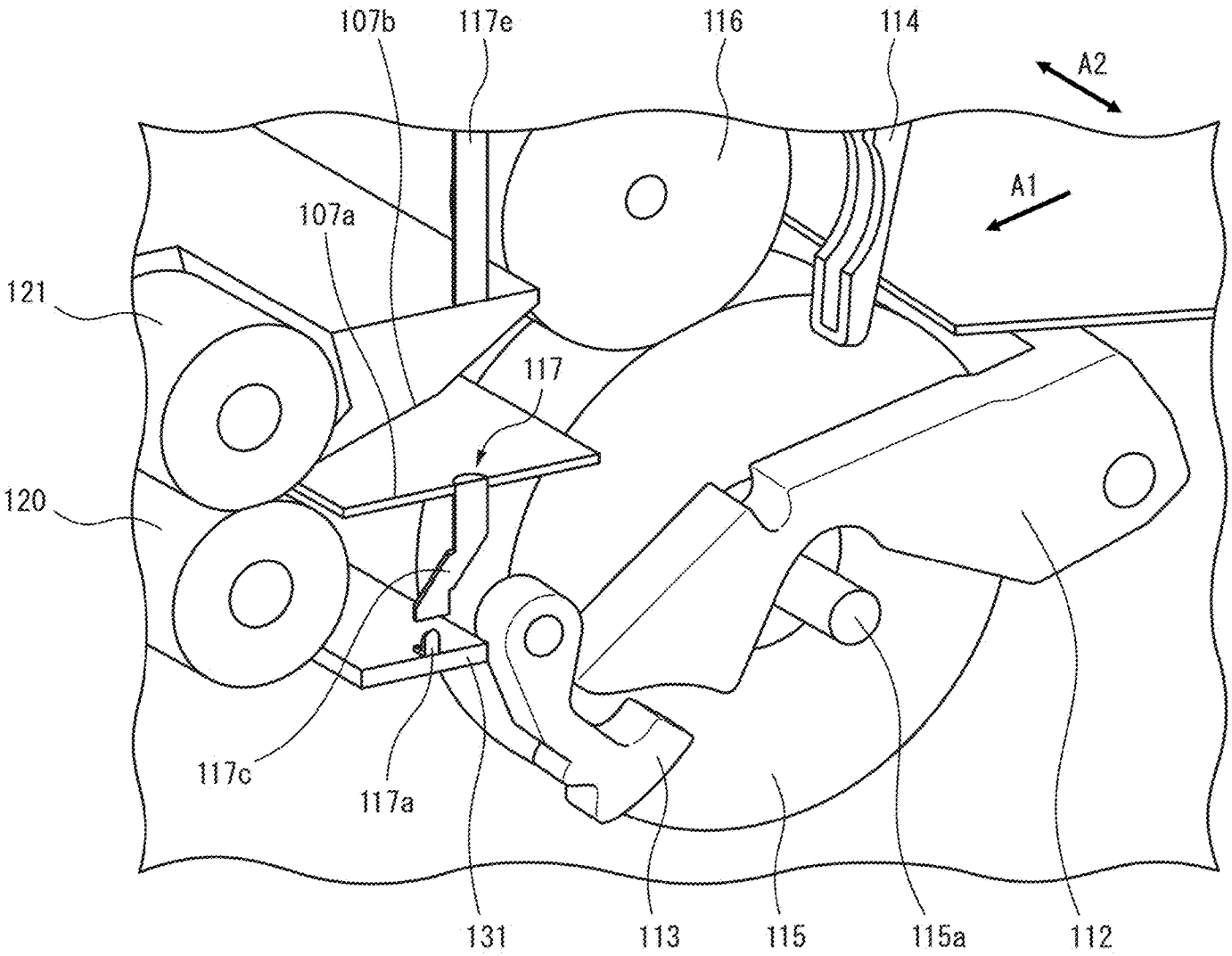
FIG. 4B is a schematic diagram for illustrating the operation of the set guide 112, etc.

FIG. 4A and FIG. 4B are schematic diagrams for illustrating an operation of the set guide 112, the moving mechanism 113 and the flap 114. FIG. 4A is a schematic view of the setting guide 112, the moving mechanism 113 and the flap 114 during media feeding, as viewed from the side. FIG. 4B is a schematic view illustrating a cross section acquired by cutting the medium conveyance path at the position of the first sensor 117 during medium feeding, as viewed from the downstream side and the side.

As illustrated in FIG. 4A and FIG. 4B, the moving mechanism 113 swings downward according to the driving force from the motor and is apart from the end portion on the downstream side of the set guide 112 when the feeding of the medium is executed. The end portion on the downstream side of the set guide 112 is spaced from the moving mechanism 113, so as not to be held by the moving mechanism 113. Thereby, the set guide 112 swings below the medium conveying surface, and is apart from the lower surface of the medium placed on the medium tray 103. Hereinafter, as illustrated in FIG. 4A and FIG. 4B, a position at which the set guide 112 is apart from the lower surface of the medium placed on the medium tray 103, may be referred to as a release position. By the set guide 112 located in the release position, the engagement of the flap 114 and the set guide 112 is released. Thereby, the flap 114 is pushed by the front end of the medium placed on the medium tray 103 and swings, and the medium can enter the nip position of the feed roller 115 and the brake roller 116. Thus, the flap 114 allows the medium to enter the nip position of the feed roller 115 and the brake roller 116 when the set guide 112 is located at the release position.

Figure 5:
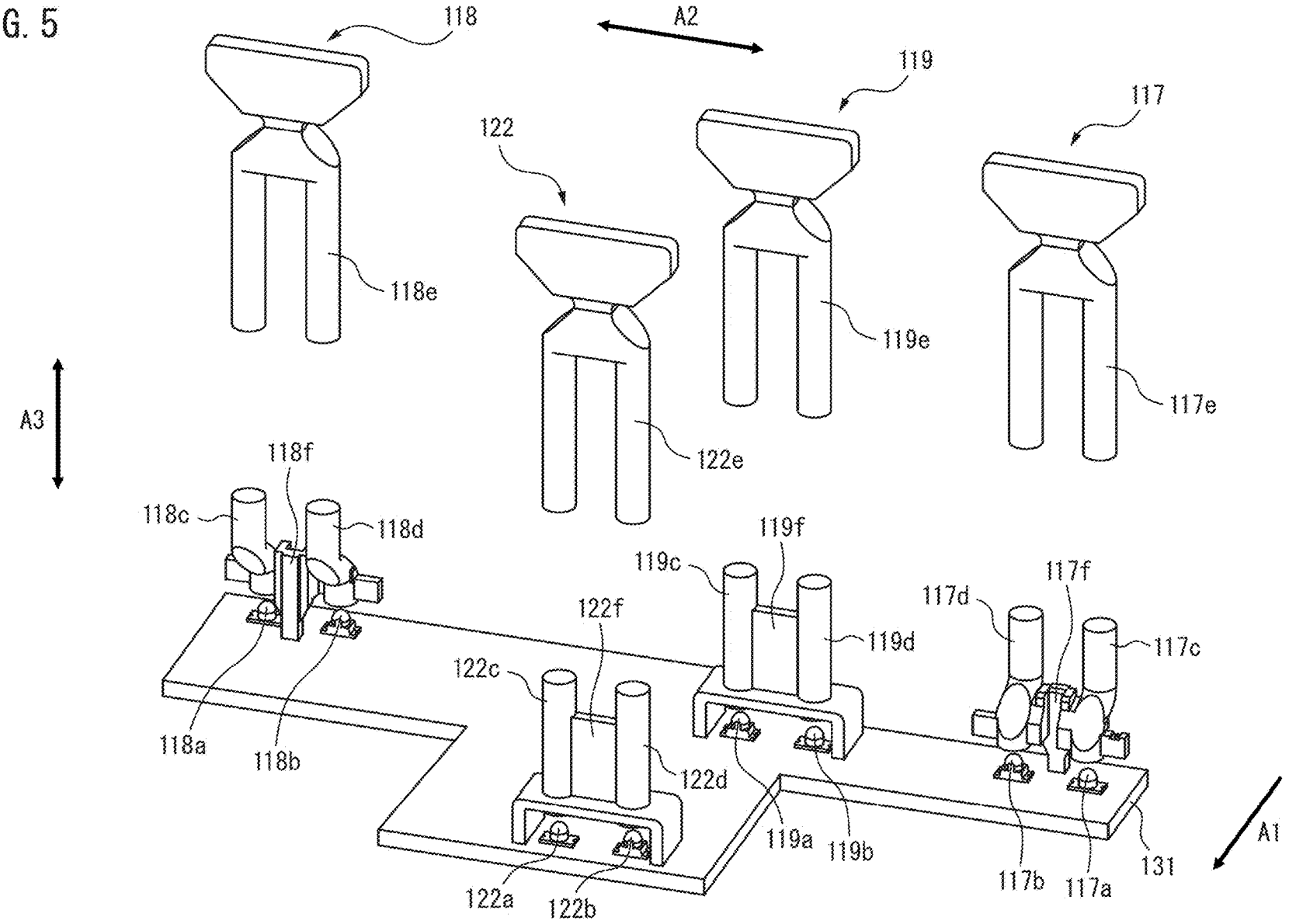
FIG. 5 is a schematic diagram for illustrating a first sensor 117, etc.

FIG. 5 is a schematic diagram for illustrating the first sensor 117, the second sensor 118, the third sensor 119 and the fourth sensor 122. FIG. 5 is a schematic view of only the first sensor 117, the second sensor 118, the third sensor 119 and the fourth sensor 122, as viewed from the downstream side, in a state in which components other than the first sensor 117, the second sensor 118, the third sensor 119 and the fourth sensor 122 are not shown.

As illustrated in FIG. 5, the first sensor 117 is a regression type prism sensor, and includes a light emitting element 117*a*, a light receiving element 117*b*, a first light guide 117*c*, a second light guide 117*d*, a third light guide 117*e*, a bond portion 117*f*, etc.

The light emitting element 117*a* and the light receiving element 117*b* are mounted on a substrate 131 provided in the lower housing 101, and are used for detecting a medium. The light emitting element 117*a* is located on an outside of the medium conveyance path with the lower guide 107*a* in between. The light emitting element 117*a* is an LED (Light Emitting Diode), etc., and is located so as to face the lower end portion of the first light guide 117*c*, and emit light toward the lower end portion of the first light guide 117*c*. The light receiving element 117*b* is located on the outside of the medium conveyance path with the lower guide 107*a* in between. The light receiving element 117*b* is located so as to face the lower end portion of the second light guide 117*d*, to receive the light emitted by the light emitting element 117*a* and guided by the first light guide 117*c*, the third light guide 117*e* and the second light guide 117*d* from the second light guide 117*d*. The light receiving element 117*b* generates and outputs a first optical signal being an electrical signal corresponding to an intensity of the received light. For example, the first optical signal is generated so that the signal value is proportional to an amount of the light received in the light receiving element 117*b*. The signal value of the first optical signal and the amount of the light received in the light receiving element 117*b* may have other relationships such as inversely proportional, etc. Since the light emitting element 117*a* and the light receiving element 117*b* are mounted on the same substrate 131, the medium conveying apparatus 100 can reduce the number of substrates, and reduce the apparatus cost and the apparatus size.

As illustrated in FIG. 3A, FIG. 3B, FIG. 4A, and FIG. 4B, the light emitting element 117*a* and the light receiving element 117*b* are located on the outside of the medium conveyance path with the lower guides 107*a* in between. The substrate 131 on which the light emitting element 117*a* and the light receiving element 117*b* are mounted is located at a position facing the moving mechanism 113 in the width direction A2. Further, the light emitting element 117*a* and the light receiving element 117*b* are located on the downstream side of the moving mechanism 113 so as to be apart from the moving mechanism 113 by a predetermined distance or more in the medium conveying direction A1. The predetermined distance is, for example, 3 mm.

The first light guide 117*c*, the second light guide 117*d* and the third light guide 117*e* are light guides such as prisms, and are formed of a material such as polycarbonate. The first light guide 117*c* is located on the outside of the medium conveyance path with the lower guide 107*a* in between. The first light guide 117*c* is provided in the lower housing 101 so that a lower end portion thereof faces the light emitting element 117*a* and an upper end portion thereof faces the lower guide 107*a*, to guide the light emitted from the light emitting element 117*a* to the medium conveyance path. The second light guide 117*d* is located on the outside of the medium conveyance path with the lower guide 107*a* in between. The second light guide 117*d* is provided in the lower housing 101 so that an upper end portion thereof faces the lower guide 107*a* and a lower end portion thereof faces the light receiving element 117*b*, to guide the light incident from the medium conveyance path to the light receiving element 117*b*. The third light guide 117*e* is an example of a light guide, and is located on an outside of the medium conveyance path with the upper guide 107*b* in between. The third light guide 117*e* is formed in a U-shape so that two lower end portions thereof face the upper guide 107*b*, and is provided in the upper housing 102 so that each lower end portion thereof faces the upper end portion of the first light guide 117*c* and the upper end portion of the second light guide 117*d* with the medium conveyance path in between. The third light guide 117*e* guides the light incident from the lower end portion facing the first light guide 117*c* to the lower end portion facing the second light guide 117*d*.

The bond portion 117*f* bonds the first light guide 117*c* and the second light guide 117*d*.

Similarly, the second sensor 118 is a regression type prism sensor, and includes a light emitting element 118*a*, a light receiving element 118*b*, a first light guide 118*c*, a second light guide 118*d*, a third light guide 118*e*, a bond portion 118*f*, etc.

The light emitting element 118*a* and the light receiving element 118*b* are mounted on the substrate 131 provided in the lower housing 101, and are used for detecting a medium. The light emitting element 118*a* is located on the outside of the medium conveyance path with the lower guide 107*a* in between. The light emitting element 118*a* is an LED, etc., and is located so as to face the lower end portion of the first light guide 118*c*, and emits light toward the lower end portion of the first light guide 118*c*. The light receiving element 118*b* is located on the outside of the medium conveyance path with the lower guide 107*a* in between. The light receiving element 118*b* is located so as to face the lower end portion of the second light guide 118*d*, to receive the light emitted by the light emitting element 118*a* and guided by the first light guide 118*c*, the third light guide 118*e* and the second light guide 118*d* from the second light guide 118*d*. The light receiving element 118*b* generates and outputs a second optical signal being an electrical signal corresponding to an intensity of the received light. For example, the second optical signal is generated so that the signal value is proportional to an amount of the light received in the light receiving element 118*b*. The signal value of the second optical signal and the amount of the light received in the light receiving element 118*b* may have other relationships such as inversely proportional, etc. Since the light emitting element 118*a* and the light receiving element 118*b* are mounted on the same substrate 131, the medium conveying apparatus 100 can reduce the number of substrates, and reduce the apparatus cost and the apparatus size.

The first light guide 118*c*, the second light guide 118*d* and the third light guide 118*e* are light guides such as prisms, and are formed of a material such as polycarbonate. The first light guide 118*c* is located on the outside of the medium conveyance path with the lower guide 107*a* in between. The first light guide 118*c* is provided in the lower housing 101 so that a lower end portion thereof faces the light emitting element 118*a* and an upper end portion thereof faces the lower guide 107*a*, to guide the light emitted from the light emitting element 118*a* to the medium conveyance path. The second light guide 118*d* is located on the outside of the medium conveyance path with the lower guide 107*a* in between. The second light guide 118*d* is provided in the lower housing 101 such that an upper end portion thereof faces the lower guide 107*a* and a lower end portion thereof faces the light receiving element 118*b*, and guides the light incident from the medium conveyance path to the light receiving element 118*b*. The third light guide 118*e* is located on the outside of the medium conveyance path with the upper guide 107*b* in between. The third light guide 118*e* is formed in a U-shape so that two lower end portions thereof face the upper guide 107*b*, and is provided in the upper housing 102 so that each lower end portion thereof faces the upper end portion of the first light guide 118*c* and the upper end portion of the second light guide 118*d* with the medium conveyance path in between. The third light guide 118*e* guides the light incident from the lower end portion facing the first light guide 118*c* to the lower end portion facing the second light guide 118*d*.

The bond portion 118*f* bonds the first light guide 118*c* and the second light guide 118*d*.

Similarly, the third sensor 119 is a regression type prism sensor, and includes a light emitting element 119*a*, a light receiving element 119*b*, a first light guide 119*c*, a second light guide 119*d*, a third light guide 119*e*, a bond portion 119*f*, etc.

The light emitting element 119*a* and the light receiving element 119*b* are mounted on a substrate 131 provided in the lower housing 101, and are used for detecting a medium. The light emitting element 119*a* is located on the outside of the medium conveyance path with the lower guide 107*a* in between. The light emitting element 119*a* is an LED, etc., and is located so as to face the lower end portion of the first light guide 119*c*, and emits light toward the lower end portion of the first light guide 119*c*. The light receiving element 119*b* is located on the outside of the medium conveyance path with the lower guide 107*a* in between. The light receiving element 119*b* is located so as to face the lower end portion of the second light guide 119*d*, to receive light emitted by the light emitting element 119*a* and guided by the first light guide 119*c*, the third light guide 119*e* and the second light guide 119*d* from the second light guide 119*d*. The light receiving element 119*b* generates and outputs a third optical signal being an electrical signal corresponding to an intensity of the received light. For example, the third optical signal is generated so that the signal value is proportional to an amount of the light received in the light receiving element 119*b*. The signal value of the third optical signal and the amount of the light received in the light receiving element 119*b* may have other relationships such as inversely proportional, etc. Since the light emitting element 119*a* and the light receiving element 119*b* are mounted on the same substrate 131, the medium conveying apparatus 100 can reduce the number of substrates, and reduce the apparatus cost and the apparatus size.

The first light guide 119*c*, the second light guide 119*d* and the third light guide 119*e* are light guides such as prisms, and are formed of a material such as polycarbonate. The first light guide 119*c* is located on the outside of the medium conveyance path with the lower guide 107*a* in between. The first light guide 119*c* is provided in the lower housing 101 such that the lower end faces the light emitting element 119*a* and the upper end faces the lower guide 107*a*, and guides the light emitted from the light emitting element 119*a* to the medium conveyance path. The second light guide 119*d* is located on the outside of the medium conveyance path with the lower guide 107*a* in between. The second light guide 119*d* is provided in the lower housing 101 such that an upper end portion thereof faces the lower guide 107*a* and a lower end portion thereof faces the light receiving element 119*b*, and guides the light incident from the medium conveyance path to the light receiving element 119*b*. The third light guide 119*e* is located on the outside of the medium conveyance path with the upper guide 107*b* in between. The third light guide 119*e* is formed in a U-shape so that two lower end portions thereof face the upper guide 107*b*, and is provided in the upper housing 102 so that each lower end portion thereof faces the upper end portion of the first light guide 119*c* and the upper end portion of the second light guide 119*d* with the medium conveyance path in between. The third light guide 119*e* guides the light incident from the lower end portion facing the first light guide 119*c* to the lower end portion facing the second light guide 119*d*.

The bond portion 119*f* bonds the first light guide 119*c* and the second light guide 119*d*.

Similarly, the fourth sensor 122 is a regression type prism sensor, and includes a light emitting element 122*a*, a light receiving element 122*b*, a first light guide 122*c*, a second light guide 122*d*, a third light guide 122*e*, a bond portion 122*f*, etc.

The light emitting element 122*a* and the light receiving element 122*b* are mounted on a substrate 131 provided in the lower housing 101, and are used for detecting a medium. The light emitting element 122*a* is located on the outside of the medium conveyance path with the lower guide 107*a* in between. The light emitting element 122*a* is an LED, etc., and is located so as to face the lower end portion of the first light guide 122*c*, and emits light toward the lower end portion of the first light guide 122*c*. The light receiving element 122*b* is located on the outside of the medium conveyance path with the lower guide 107*a* in between. The light receiving element 122*b* is located so as to face the lower end portion of the second light guide 122*d*, to receive light emitted by the light emitting element 122*a* and guided by the first light guide 122*c*, the third light guide 122*e* and the second light guide 122*d* from the second light guide 122*d*. The light receiving element 122*b* generates and outputs a fourth optical signal being an electrical signal corresponding to an intensity of the received light. For example, the fourth optical signal is generated so that the signal value is proportional to an amount of the light received in the light receiving element 122*b*. The signal value of the fourth optical signal and the amount of the light received in the light receiving element 122*b* may have other relationships such as inversely proportional, etc. Since the light emitting element 122*a* and the light receiving element 122*b* are mounted on the same substrate 131, the medium conveying apparatus 100 can reduce the number of substrates, and reduce the apparatus cost and the apparatus size.

The first light guide 122*c*, the second light guide 122*d* and the third light guide 122*e* are light guides such as prisms, and are formed of a material such as polycarbonate. The first light guide 122*c* is located on the outside of the medium conveyance path with the lower guide 107*a* in between. The first light guide 122*c* is provided in the lower housing 101 such that the lower end faces the light emitting element 122*a* and the upper end faces the lower guide 107*a*, and guides the light emitted from the light emitting element 122*a* to the medium conveyance path. The second light guide 122*d* is located on the outside of the medium conveyance path with the lower guide 107*a* in between. The second light guide part 122*d* is provided in the lower housing 101 such that an upper end thereof faces the lower guide 107*a* and a lower end thereof faces the light receiving element 122*b*, and guides the light incident from the medium conveyance path to the light receiving element 122*b*. The third light guide 122*e* is located on the outside of the medium conveyance path with the upper guide 107*b* in between. The third light guide 122*e* is formed in a U-shape so that two lower end portions thereof face the upper guide 107*b*, and is provided in the upper housing 102 so that each lower end portion thereof faces the upper end portion of the first light guide 122*c* and the upper end portion of the second light guide 122*d* with the medium conveyance path in between. The third light guide 122*e* guides the light incident from the lower end portion facing the first light guide 122*c* to the lower end portion facing the second light guide 122*d*.

The bond portion 122*f* bonds the first light guide 122*c* and the second light guide 122*d*.

As described above, in the medium conveying apparatus 100, all of the light emitting elements and the light receiving elements of the first sensor 117, the second sensor 118, the third sensor 119 and the fourth sensor 122 are mounted on the same substrate 131. Therefore, the medium conveying apparatus 100 can reduce the number of substrates, and reduce the apparatus cost and the apparatus size.

Figure 6:
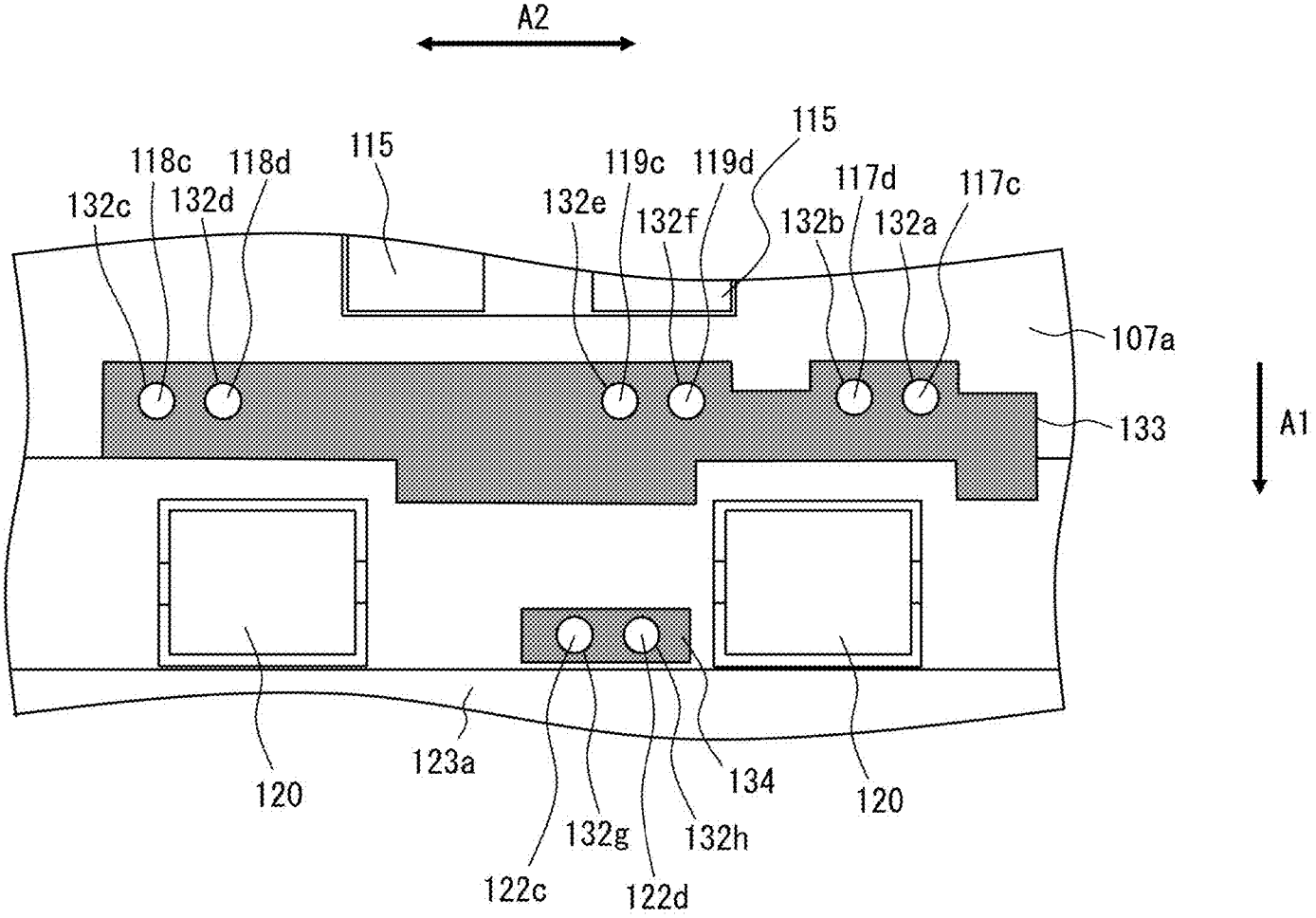
FIG. 6 is a schematic diagram for illustrating a positional relationship of the first sensor 117, etc.

FIG. 6 is a schematic diagram for illustrating a positional relationship between the first sensor 117, the second sensor 118, the third sensor 119 and the fourth sensor 122. FIG. 6 is a schematic view of the lower guide 107*a* as viewed from above.

As illustrated in FIG. 6, the lower guide 107*a* has a first hole portion 132*a*, a second hole portion 132*b*, a third hole portion 132*c*, a fourth hole portion 132*d*, a fifth hole portion 132*e*, a sixth hole portion 132*f*, a seventh hole portion 132*g* and an eighth hole portion 132*h*.

The first to sixth hole portions 132*a* to 132*f* are provided at substantially the same position between the feed roller 115 and the brake roller 116, and the first conveying roller 120 and the second conveying roller 121 in the medium conveying direction A1. The first to sixth hole portions 132*a* to 132*f* are located in the vicinity of the feed roller 115 and the brake roller 116, particularly within a predetermined distance (for example, within 50 mm) from a center position of the nip of the feed roller 115 and the brake roller 116 in the medium conveying direction A1. The first to sixth hole portions 132*a* to 132*f* are located apart from each other along in the width direction A2. The seventh to eighth hole portions 132*g* to 132*h* are provided at substantially the same position between the first conveying roller 120 and the second conveying roller 121, and the imaging device 123 in the medium conveying direction A1. The seventh to eighth hole portions 132*g* to 132*h* are located apart from each other along in the width direction A2.

The first hole portion 132*a* is an example of a first opening, and is located at a position facing the first light guide 117*c* of the first sensor 117, and is provided so as to engage with the first light guide 117*c*. The second hole portion 132*b* is an example of a second opening, and is located at a position facing the second light guide 117*d* of the first sensor 117, and is provided so as to engage with the second light guide 117*d*. Further, the second hole portion 132*b* is an example of an opening. The first hole portion 132*a* and the second hole portion 132*b* are provided in the lower guide 107*a* to pass the light emitted from the light emitting element 117*a* of the first sensor 117. As described above, the first light guide 117*c* and the second light guide 117*d* are bonded by the bond portion 117*f* and are engaged with the first hole portion 132*a* and the second hole portion 132*b*. The first light guide 117*c* and the second light guide 117*d* are positioned by the bond portion 117*f*, the first hole portion 132*a* and the second hole portion 132*b* in the direction along the lower guide 107*a* (conveying surface), and are appropriately fixed to the lower housing 101.

In the width direction A2 perpendicular to the medium conveying direction, the second hole portion 132*b* engaged with the second light guide 117*d* to guide the light to the light receiving element 117*b* is located on the center side with respect to the first hole portion 132*a* engaged with the first light guide 117*c* to guide the light emitted from the light emitting element 117*a*. That is, in the width direction A2 perpendicular to the medium conveying direction, the light receiving element 117*b* is located on the center side with respect to the light emitting element 117*a*.

Similarly, the third hole portion 132*c* is located at a position facing the first light guide 118*c* of the second sensor 118, and is provided so as to engage with the first light guide 118*c*. The fourth hole portion 132*d* is located at a position facing the second light guide 118*d* of the second sensor 118, and is provided so as to engage with the second light guide 118*d*. The fourth hole portion 132*d* is an example of a predetermined opening, and is located apart from the second hole portion 132*b* along in the width direction A2 perpendicular to the medium conveying direction. The third hole portion 132*c* or the fourth hole portion 132*d* is an example of a fifth opening, and is located apart from the first hole portion 132*a* and the second hole portion 132*b* along in the width direction A2 perpendicular to the medium conveying direction. The third hole portion 132*c* and the fourth hole portion 132*d* are provided in the lower guide 107*a* to pass the light emitted from the light emitting element 118*a* of the second sensor 118. As described above, the first light guide 118*c* and the second light guide 118*d* are bonded by the bond portion 118*f*, and are engaged with the third hole portion 132*c* and the fourth hole portion 132*d*. The first light guide 118*c* and the second light guide 118*d* are positioned by the bond portion 118*f*, the third hole portion 132*c* and the fourth hole portion 132*d* in the direction along the lower guide 107*a* (conveying surface), and are appropriately fixed to the lower housing 101.

In the width direction A2 perpendicular to the medium conveying direction, the fourth hole portion 132*d* engaged with the second light guide 118*d* to guide the light to the light receiving element 118*b* is located on the center side with respect to the third hole portion 132*c* engaged with the third light guide 118*e* to guide the light emitted from the light emitting element 118*a*. That is, in the width direction A2 perpendicular to the medium conveying direction, the light receiving element 118*b* is located on the center side with respect to the light emitting element 118*a*. The light emitting element 118*a* and the light receiving element 118*b* of the second sensor 118 are examples of a second light emitting element and a second light receiving element, and detect the medium using the third hole portion 132*c* and the fourth hole portion 132*d*.

Similarly, the fifth hole portion 132*e* is located at a position facing the first light guide 119*c* of the third sensor 119, and is provided so as to engage with the first light guide 119*c*. The sixth hole portion 132*f* is located at a position facing the second light guide 119*d* of the third sensor 119, and is provided so as to engage with the second light guide 119*d*. The fifth hole portion 132*e* and the sixth hole portion 132*f* are provided in the lower guide 107*a* to pass the light emitted from the light emitting element 119*a* of the third sensor 119. As described above, the first light guide 119*c* and the second light guide 119*d* are bonded by the bond portion 119*f*, and are engaged with the fifth hole portion 132*e* and the sixth hole portion 132*f* The first light guide 119*c* and the second light guide 119*d* are positioned by the bond portion 119*f*, the fifth hole portion 132*e* and the sixth hole portion 132*f* in the direction along the lower guide 107*a* (conveying surface), and are appropriately fixed to the lower housing 101.

Similarly, the seventh hole portion 132*g* is located at a position facing the first light guide 122*c* of the fourth sensor 122, and is provided so as to engage with the first light guide 122*c*. The eighth hole portion 132*h* is located at a position facing the second light guide 122*d* of the fourth sensor 122, and is provided so as to engage with the second light guide 122*d*. The seventh hole portion 132*g* and the eighth hole portion 132*h* are provided in the lower guide 107*a* to pass the light emitted from the light emitting element 122*a* of the fourth sensor 122. As described above, the first light guide part 122*c* and the second light guide part 122*d* are bonded by the bond part 122*f*, and are engaged with the seventh hole part 132*g* and the eighth hole part 132*h*. The first light guide 122*c* and the second light guide 122*d* are positioned by the bond portion 122*f*, the seventh hole portion 132*g* and the eighth hole portion 132*h* in the direction along the lower guide 107*a* (conveying surface), and are appropriately fixed to the lower housing 101.

The peripheral portion 133 of the first to sixth hole portions 132*a* to 132*f* of the lower guide 107*a* are formed of a resin member having a color other than white (e.g., gray or black). In particular, the peripheral portion 133 is formed of a member having a reflectivity of 55% or less so that the reflectivity of the periphery of the first to sixth hole portions 132*a* to 132*f* of the lower guide 107*a* is 55% or less.

Similarly, the peripheral portion 134 of the seventh to eighth hole portions 132*g* to 132*h* of the lower guide 107*a* are formed of a resin member having a color other than white (e.g., gray or black). In particular, the peripheral portion 134 is formed of a member having a reflectivity of 55% or less so that the reflectivity of the periphery of the seventh to eighth hole portions 132*g* to 132*h* of the lower guide 107*a* is 55% or less.

In the lower guide 107*a*, the peripheral portion 133 and the peripheral portion 134 are formed of a member separate from the other portions. In the lower guide 107*a*, the peripheral portion 133 and/or the peripheral portion 134 may be formed of a member integral with the other portions. Further, in the lower guide 107*a*, the reflectivity in the periphery of at least one of the second hole portion 132*b*, the fourth hole portion 132*d*, the sixth hole portion 132*f* and the eighth hole portion 132*h* may be 55% or less, and the reflectivity in the periphery of the other hole portion may be more than 55%.

Figure 7:
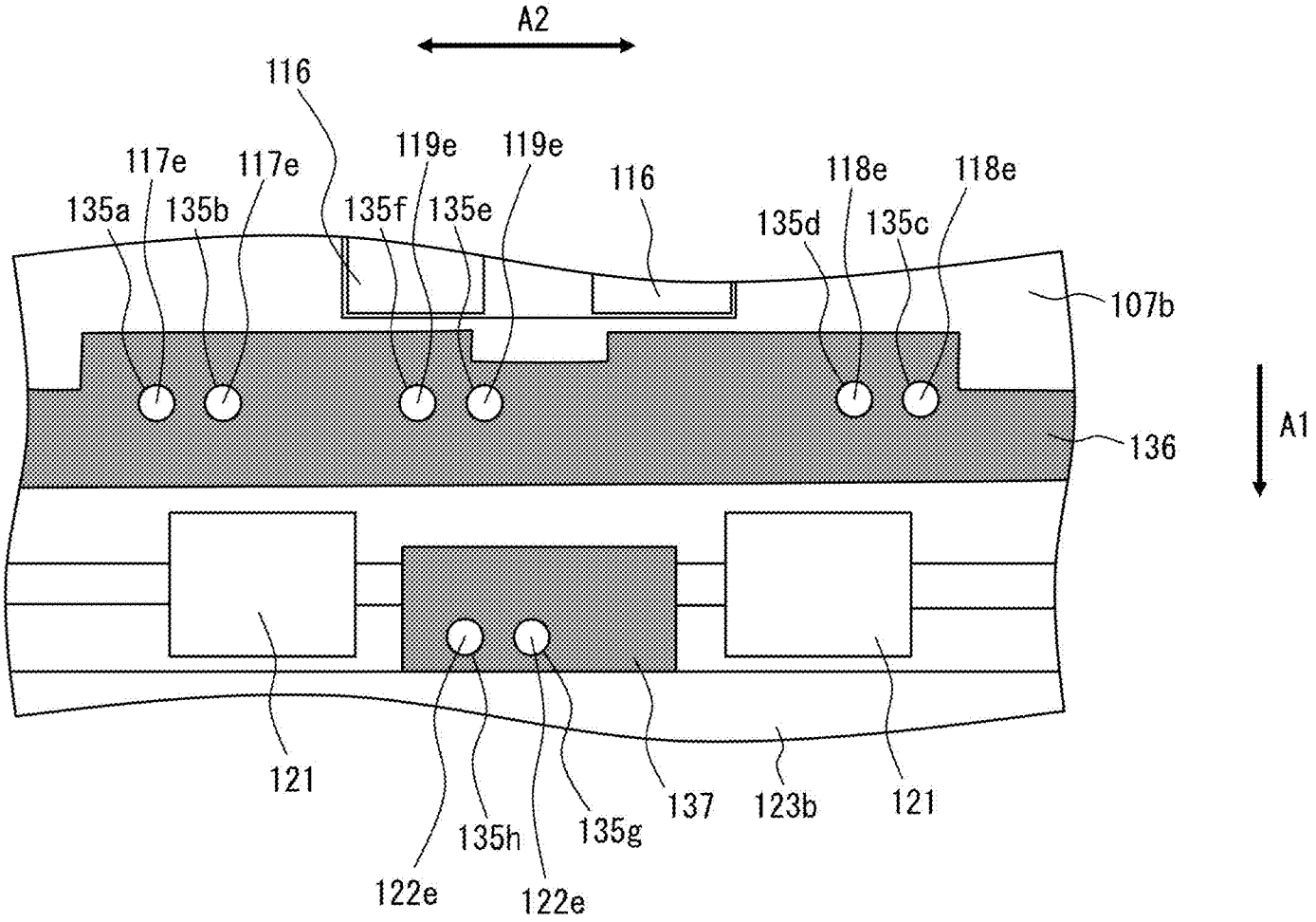
FIG. 7 is a schematic diagram for illustrating the positional relationship of the first sensor 117, etc.

FIG. 7 is a schematic diagram for illustrating a positional relationship between the first sensor 117, the second sensor 118, the third sensor 119 and the fourth sensor 122. FIG. 7 is a schematic view of the upper guide 107*b* as viewed from the lower side.

As illustrated in FIG. 7, the upper guide 107*b* includes a ninth hole portion 135*a*, a tenth hole portion 135*b*, an eleventh hole portion 135*c*, a twelfth hole portion 135*d*, a thirteenth hole portion 135*e*, a fourteenth hole portion 135*f*, a fifteenth hole portion 135*g* and a sixteenth hole portion 135*h*.

The ninth to sixteenth hole portions 135*a* to 135*h* are located to face the first to eighth hole portions 132*a* to 132*h* with the medium conveyance path in between, respectively.

The ninth hole portion 135*a* is an example of a third opening. The ninth hole portion 135*a* is located at a position facing the lower end portion of the third light guide 117*e* of the first sensor 117 on the side of the first light guide 117*c*, and is provided so as to engage with the lower end portion of the third light guide 117*e* on the side of the first light guide 117*c*. The tenth hole portion 135*b* is an example of a fourth opening. The tenth hole portion 135*b* is located at a position facing the lower end portion of the third light guide 117*e* of the first sensor 117 on the side of the second light guide 117*d*, and is provided so as to engage with the lower end portion of the third light guide 117*e* on the side of the second light guide 117*d*. That is, the third light guide 117*e* is provided so as to guide the light incident from the ninth hole portion 135*a* to the tenth hole portion 135*b*. The ninth hole portion 135*a* is an example of the second guide opening. The ninth hole portion 135*a* and the tenth hole portion 135*b* are provided in the upper guide 107*b* to pass the light emitted from the light emitting element 117*a* of the first sensor 117.

Similarly, the eleventh hole portion 135*c* is located at a position facing the lower end portion of the third light guide 118*e* of the second sensor 118 on the side of the first light guide 118*c*, and is provided so as to engage with the lower end portion of the third light guide 118*e* on the side of the first light guide 118*c*. The twelfth hole portion 135*d* is located at a position facing the lower end portion of the third light guide 118*e* of the second sensor 118 on the side of the second light guide 118*d*, and is provided so as to engage with the lower end portion of the third light guide 118*e* on the side of the first light guide 118*c*. That is, the third light guide 118*e* is provided so as to guide the light incident from the eleventh hole portion 135*c* to the twelfth hole portion 135*d*. The eleventh hole portion 135*c* and the twelfth hole portion 135*d* are provided in the upper guide 107*b* to pass the light emitted from the light emitting element 118*a* of the second sensor 118.

Similarly, the thirteenth hole portion 135*e* is located at a position facing the lower end portion of the third light guide 119*e* of the third sensor 119 on the side of the first light guide 119*c*, and is provided so as to engage with the lower end portion of the third light guide 119*e* on the side of the first light guide 119*c*. The fourteenth hole portion 135*f* is located at a position facing the lower end portion of the third light guide 119*e* of the third sensor 119 on the side of the second light guide 119*d*, and is provided so as to engage with the lower end portion of the third light guide 119*e* on the side of the first light guide 119*c*. That is, the third light guide 119*e* is provided so as to guide the light incident from the thirteenth hole portion 135*e* to the fourteenth hole portion 135*f*. The thirteenth hole portion 135*e* and the fourteenth hole portion 135*f* are provided in the upper guide 107*b* to pass the light emitted from the light emitting element 119*a* of the third sensor 119.

Similarly, the fifteenth hole portion 135*g* is located at a position facing the lower end portion of the third light guide 122*e* of the fourth sensor 122 on the side of the first light guide 122*c*, and is provided so as to engage with the lower end portion of the third light guide 122*e* on the side of the first light guide 122*c*. The sixteenth hole portion 135*h* is located at a position facing the lower end portion of the third light guide 122*e* of the fourth sensor 122 on the side of the second light guide 122*d*, and is provided so as to engage with the lower end portion of the third light guide 122*e* on the side of the second light guide 122*d*. That is, the third light guide 122*e* is provided so as to guide the light incident from the fifteenth hole portion 135*g* to the sixteenth hole portion 135*h*. The fifteenth hole portion 135*g* and the sixteenth hole portion 135*h* are provided in the upper guide 107*b* to pass the light emitted from the light emitting element 122*a* of the fourth sensor 122.

The peripheral portion 136 of the ninth to fourteenth hole portions 135*a* to 135*f* of the upper guide 107*b* is formed of a resin member having a color other than white (e.g., gray or black). In particular, the peripheral portion 136 is formed of a member having a reflectivity of 55% or less so that a reflectivity in a periphery of the ninth to fourteenth hole portions 135*a* to 135*f* of the upper guide 107*b* is 55% or less.

Similarly, the peripheral portion 137 of the fifteenth to sixteenth hole portions 135*g* to 135*h* of the top guide 107*b* is formed of a resin member having a color other than white (e.g., gray or black). In particular, the peripheral portion 136 is formed of a member having a reflectivity of 55% or less so that a reflectivity in a periphery of the fifteenth to sixteenth hole portions 135*g* to 135*h* of the upper guide 107*b* is 55% or less.

In the upper guide 107*b*, the peripheral portion 136 and the peripheral portion 137 are formed of a member separate from the other portions. In the upper guide 107*b*, the peripheral portion 136 and/or the peripheral portion 137 may be formed of a member integral with the other portions. Further, in the upper guide 107*b*, the reflectivity in the periphery of at least one of the ninth hole portion 135*a*, the eleventh hole portion 135*c*, the thirteenth hole portion 135*e* and the fifteenth hole portion 135*g* may be 55% or less, and the reflectivity in the periphery of the other hole portion may be more than 55%. Further, in the upper guide 107*b*, the reflectivity of the periphery of all the hole portions may be more than 55%.

Figure 8:
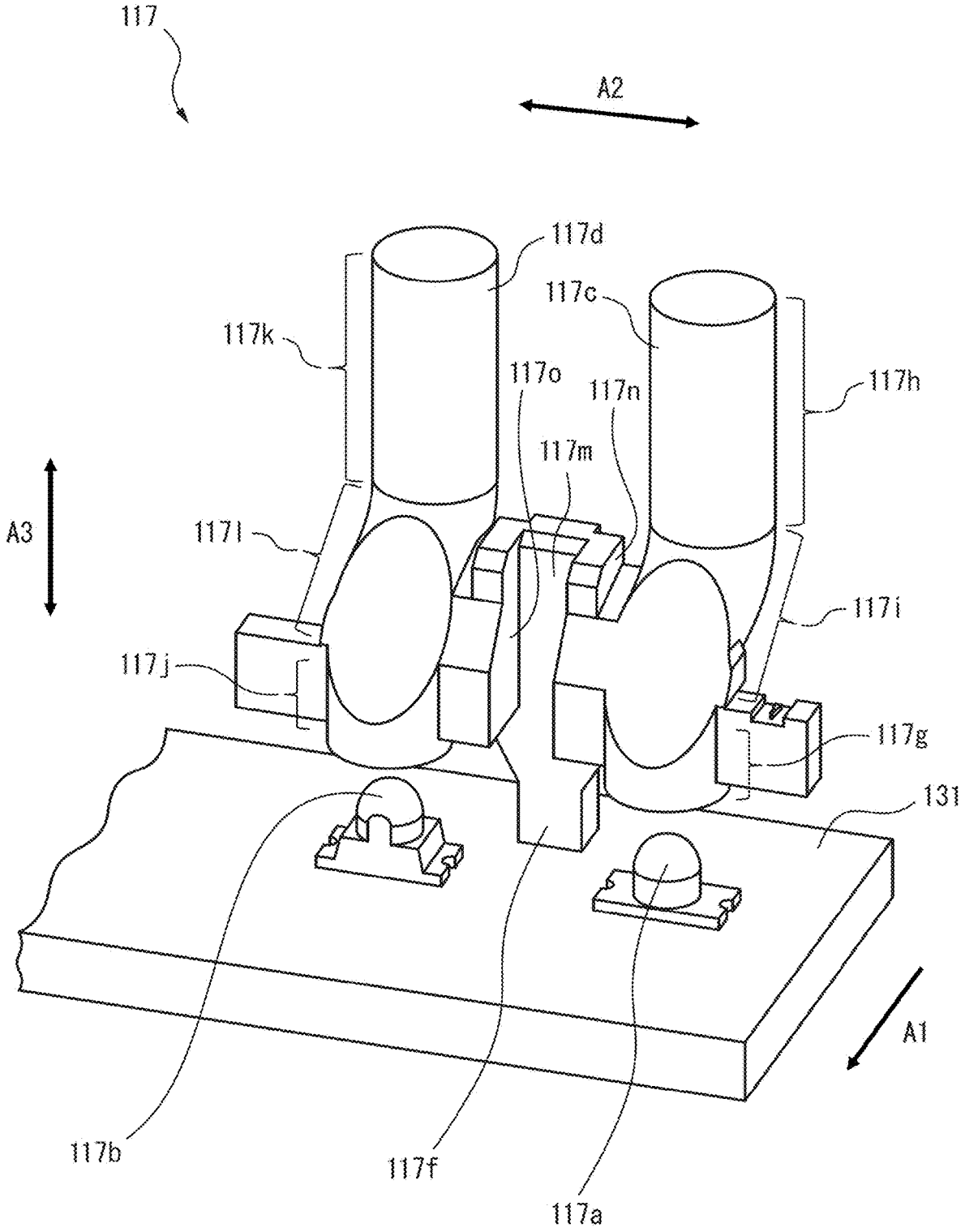
FIG. 8 is a schematic diagram for illustrating a shape of the first sensor 117.

FIG. 8 is a schematic diagram for illustrating a shape of the first sensor 117. FIG. 8 is a perspective view of the light emitting element 117*a*, the light receiving element 117*b*, the first light guide 117*c*, the second light guide 117*d* and the bond portion 117*f* of the first sensor 117 as viewed from the downstream side.

As illustrated in FIG. 8, the first light guide 117*c* is formed in a tubular (cylindrical) shape. The first light guide 117*c* includes a first tube portion 117*g*, a second tube portion 117*h* and a third tube portion 117*i*. The first tube portion 117*g* is provided on the lower end portion side facing the light emitting element 117*a*. The second tube portion 117*h* is provided on the upper end portion side facing the first hole portion 132*a*. The third tube portion 117*i* is provided between the first tube portion 117*g* and the second tube portion 117*h*. The first tube portion 117*g* and the second tube portion 117*h* are provided so as to be parallel to each other, and the third tube portion 117*i* is provided so as to be inclined with respect to the first tube portion 117*g* and the second tube portion 117*h*.

Similarly, the second light guide 117*d* is formed in a tubular (cylindrical) shape. The second light guide 117*d* includes a fourth tube portion 117*j*, a fifth tube portion 117*k* and a sixth tube portion 117*l*. The fourth tube portion 117*j* is provided on the lower end portion side facing the light receiving element 117*b*. The fifth tube portion 117*k* is provided on the upper end portion side facing the second hole portion 132*b*. The sixth tube portion 117*l* is provided between the fourth tube portion 117*j* and the fifth tube portion 117*k*. The fourth tube portion 117*j* and the fifth tube portion 117*k* are provided so as to be parallel to each other, and the sixth tube portion 117*l* is provided so as to be inclined with respect to the fourth tube portion 117*j* and the fifth tube portion 117*k*.

The lower end portions of the first light guide 117*c* and the second light guide 117*d* are located on the downstream side of the upper end portions of the first light guide 117*c* and the second light guide 117*d*, in the medium conveying direction A1. That is, the light emitting element 117*a* and the light receiving element 117*b* are located on the downstream side of the first hole portion 132*a* and the second hole portion 132*b*, in the medium conveying direction A1. The first light guide 117*c* is bent so as to guide the light emitted from the light emitting element 117*a* to the first hole portion 132*a*, and the second light guide 117*d* is bent to guide the light incident from the second hole portion 132*b* to the light receiving element 117*b*.

The first sensor 117 is used for detecting the front end of the medium fed by the feed roller 115 and the brake roller 116. The medium conveying apparatus 100 determines whether or not a jam or a skew of the medium has occurred based on the detection result of the front end of the medium by the first sensor 117, and stops conveying the medium when the jam or the skew of the medium occurs. The first sensor 117 needs to detect the front end of the medium that has passed through the feed roller 115 and the brake roller 116 as early as possible so that the medium conveying apparatus 100 can stop conveying the medium as early as possible when the jam or the skew of the medium occurs. Therefore, the closer to the nip position of the feed roller 115 and the brake roller 116, the arrangement positions of the first hole portion 132*a*, the second hole portion 132*b*, the ninth hole portion 135*a* and the tenth hole portion 135*b* used for detecting the front end of the medium are, the more preferable.

On the other hand, as illustrated in FIG. 3B and FIG. 4B, the moving mechanism 113 is located on the upstream side of the light emitting element 117*a* and the light receiving element 117*b*, and in the vicinity of the light emitting element 117*a* and the light receiving element 117*b* in the medium conveying direction A1. The moving mechanism 113 is located in the vicinity of the feed roller 115, since it is used for moving the set guide 112 to set the medium supplied to the feed roller 115. As illustrated in FIG. 3A, FIG. 3B, FIG. 4A and FIG. 4B, the light emitting element 117*a* and the light receiving element 117*b* are mounted on the substrate 131, and the substrate 131 is located on the downstream side of the moving mechanism 113. Since wirings for applying a voltage to the light emitting element 117*a* and the light receiving element 117*b* are mounted on the substrate 131, the light emitting element 117*a* and the light receiving element 117*b* need to be located at positions apart from the end portions of the substrate 131 to some extent. As a result, the light emitting element 117*a* and the light receiving element 117*b* are located on the downstream side of the feed roller 115 to some extent.

Since the first hole portion 132*a* and the second hole portion 132*b* are located on the upstream side of the light emitting element 117*a* and the light receiving element 117*b* in the medium conveying apparatus 100, the medium conveying apparatus 100 can detect the jam or the skew of the medium at an early stage. Thus, the medium conveying apparatus 100 can suppress the occurrence of damage to the medium.

Further, since the first light guide 117*c* and the second light guide 117*d* are bent in the medium conveying apparatus 100, the degree of freedom in the arrangement position of the light emitting element 117*a* and the light receiving element 117*b* on the substrate 131 is increased. Thereby, the substrate 131 can be easily miniaturized.

In particular, the first light guide 117*c* is bent in a dogleg shape at two locations so that the first tube portion 117*g* provided on the lower end portion side facing the light emitting element 117*a* and the second tube portion 117*h* provided on the upper end portion side facing the first hole portion 132*a* are parallel to each other. Similarly, the second light guide 117*d* is bent in a dogleg shape at two locations so that the fourth tube portion 117*j* provided on the lower end portion side facing the light receiving element 117*b* and the fifth tube portion 117*k* provided on the upper end side portion facing the second hole portion 132*b* are parallel to each other. The first tube portion 117*g* and the fourth tube portion 117*j* are located so as to be substantially perpendicular to a mounting surface of the substrate 131. The second tube portion 117*h* and the fifth tube portion 117*k* are located so as to be substantially perpendicular to the lower guide 107*a*. Therefore, since the substrate 131 is located substantially in parallel with the lower guide 107*a* in the medium conveying apparatus 100, the substrate 131 can be stabilized and the assembly can be facilitated.

Since the substrate 131 is located substantially in parallel with the lower guide 107*a*, the light emitting element 118*a* and the light receiving element 118*b* of the second sensor 118 located so as to be rotated by 180 degrees in parallel with a medium conveying surface with respect to the first sensor 117 as described later, can also be mounted on the same substrate 131. Further, the light emitting element and the light receiving element of the third sensor 119 and the fourth sensor 122 in which the first light guide and the second light guide is not bent as described later, can also be mounted on the same substrate 131. Therefore, the medium conveying apparatus 100 can reduce the number of substrates, and reduce the apparatus cost and the apparatus size.

The first light guide 117*c* and the second light guide 117*d* may be bent at only one location. The first light guide 117*c* and the second light guide 117*d* may be bent at any angle.

The bond portion 117*f* has a first side surface 117*m*, a second side surface 117*n* and a third side surface 117*o*. The first side surface 117*m* has a plane perpendicular to the medium conveying direction A1, and is attached to the substrate 131 so that the first light guide 117*c* and the second light guide 117*d* are supported on the substrate 131. The second side surface 117*n* has a plane parallel to the medium conveying direction A1 and the vertical direction A3, and is attached to one end of the first side surface 117*m* so that the first light guide 117*c* is supported by the first side surface 117*m*. The third side surface 117*o* has a plane parallel to the medium conveying direction A1 and the vertical direction A3, and is attached to the other end of the first side surface 117*m* so that the second light guide 117*d* is supported by the first side surface 117*m*.

The second side surface 117*n* and the third side surface 117*o* have planes parallel to the medium conveying direction A1 and the vertical direction A3, and thereby shield a disturbing light leaking to the second light guide 117*d* side among the light emitted from the light emitting element 117*a* and guided by the first light guide 117*c*. As a result, the medium conveying apparatus 100 can suppress the light receiving element 117*b* from receiving the disturbing light leaking from the first light guide 117*c*.

Figure 9A:
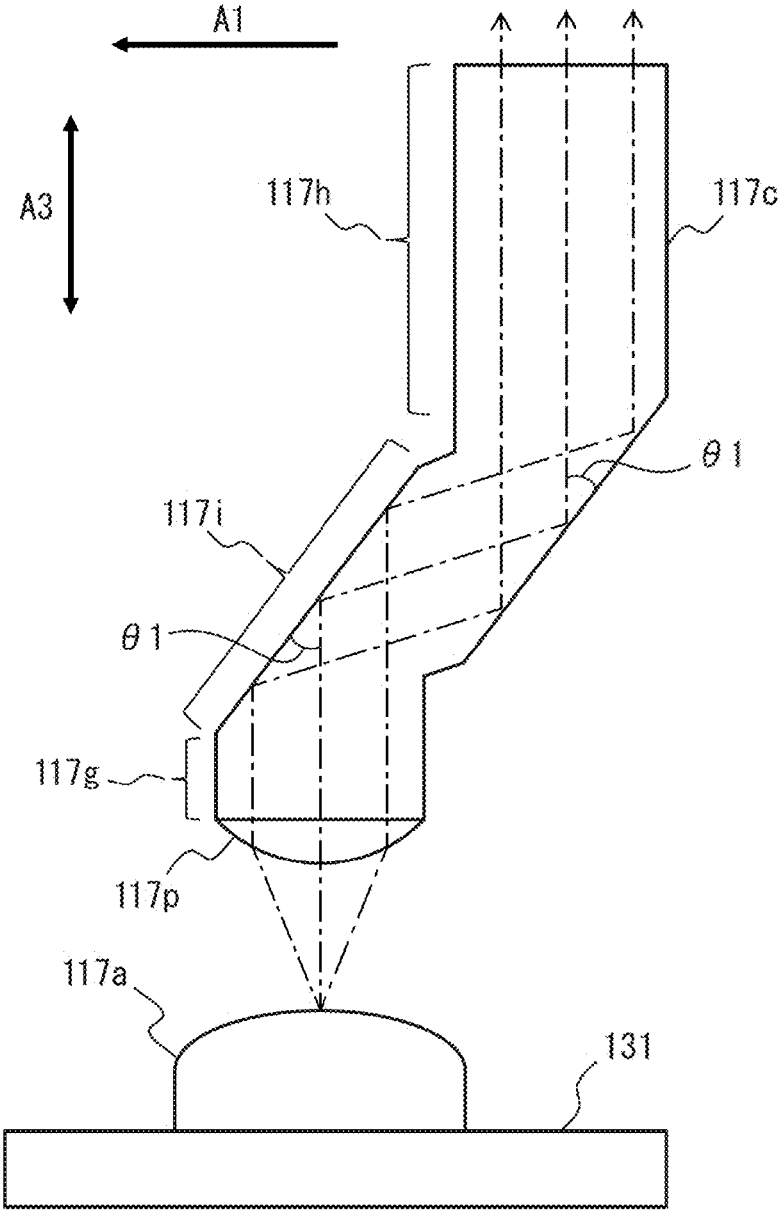
FIG. 9A is a schematic diagram for illustrating a shape of a first light guide 117*c*.

FIG. 9A is a schematic diagram for illustrating a shape of the first light guide 117*c*. FIG. 9A is a schematic view of the light emitting device 117*a* and the first light guide 117*c* of the first sensor 117 as viewed from the side.

As illustrated in FIG. 9A, the lower end portion 117*p* of the first light guide 117*c* facing the light emitting element 117*a* has a lens shape for guiding the light emitted from the light emitting element 117*a* as collimated light. That is, a collimator lens (convex lens) is formed at the lower end portion 117*p* of the first light guide 117*c*. The diffused light emitted from the light emitting element 117*a* is converted into collimated light by a lens formed at the lower end portion 117*p*, and proceeds in a direction parallel to an extending direction of the first tube portion 117*g*.

As a result, the first light guide 117*c* can suppress diffusion of the incident light and efficiently emit the light to the third light guide 117*e*, thereby suppress a reduction in an amount of the light received in the light receiving element 117*b*. As described above, in the medium conveying apparatus 100, the lower guide 107*a* and the upper guide 107*b* are located so as to be apart from each other by a predetermined distance or more so as to convey a passport. Therefore, the distance until the light emitted from the light emitting element 117*a* reaches the light receiving element 117*b* is large, and an attenuation amount of the light receiving amount in the light receiving element 117*b* with respect to the light emitting amount in the light emitting element 117*a* is large. However, since the diffused light emitted from the light emitting element 117*a* is converted into the collimated light in the medium conveying apparatus 100, the reduction in the intensity of light is suppressed, and the light receiving element 117*b* can receive a sufficient amount of light.

As described above, the third tube portion 117*i* is located so as to be inclined with respect to the first tube portion 117*g* and the second tube portion 117*h*. The third tube portion 117*i* is defined so that an angle θ1 formed by the extension direction of the first tube portion 117*g* and the second tube portion 117*h* and the extension direction of the third tube portion 117*i* is equal to or less than a critical angle of the first light guide 117*c* (third tube portion 117*i*). That is, the first light guide 117*c* is bent so as to totally reflect at least the light incident parallel to the extension direction of the first tube portion 117*g*. The first light guide 117*c* is bent so as to totally reflect the light incident parallel to the extension direction of the first tube portion 117*g* and reflected by the third tube portion 117*i* toward the second tube portion 117*h*. For example, when the first light guide 117*c* is formed of polycarbonate, the refractive index is 1.585 and the critical angle is 39.1 degrees. While the critical angle of the polycarbonate is 39.1 degrees, the angle θ1 in the present embodiment is 36 degrees. Therefore, the first light guide 117*c* can efficiently guide and output the incident light.

Figure 9B:
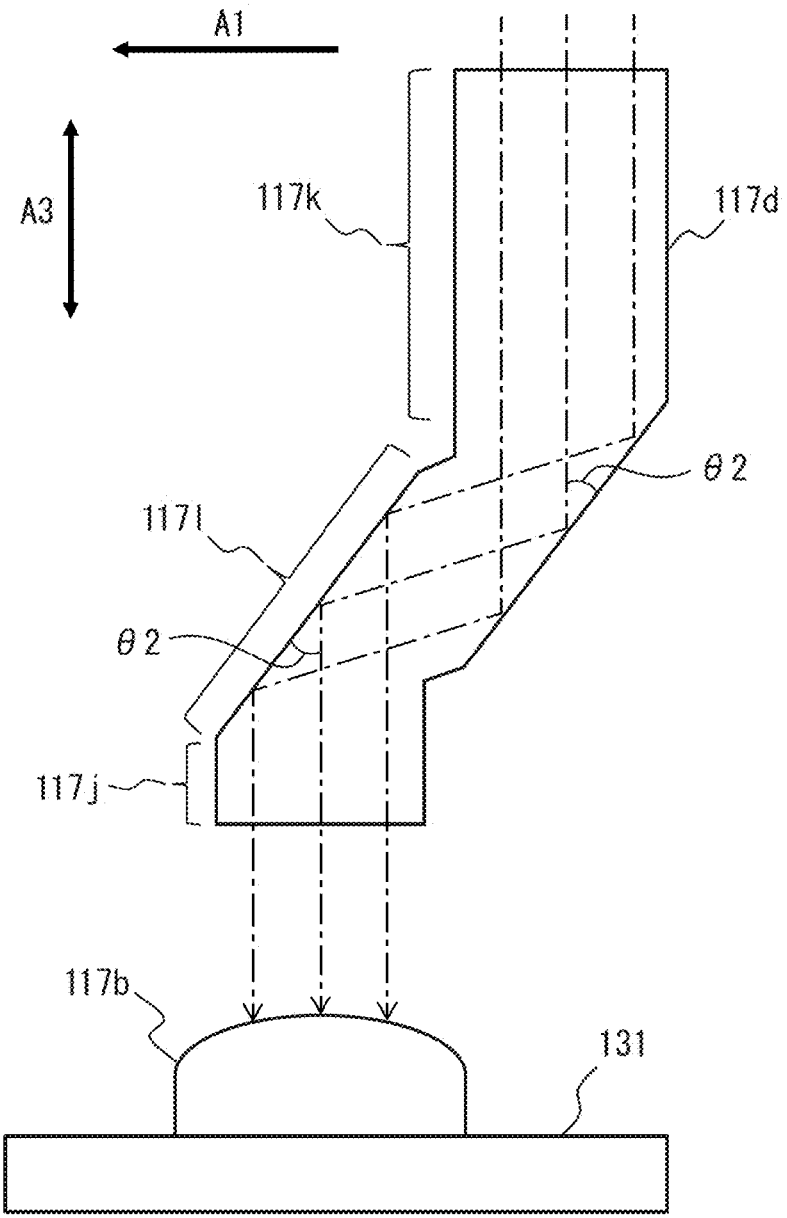
FIG. 9B is a schematic diagram for illustrating a shape of a second light guide 117*d*.

FIG. 9B is a schematic diagram for illustrating a shape of the second light guide 117*d*. FIG. 9B is a schematic view of the light receiving element 117*b* and the second light guide 117*d* of the first sensor 117 as viewed from the side.

As described above, the sixth tube portion 117*l* is located so as to be inclined with respect to the fourth tube portion 117*j* and the fifth tube portion 117*k*. The sixth tube portion 117*l* is defined so that an angle θ2 formed by the extension direction of the fourth tube portion 117*j* and the fifth tube portion 117*k* and the extension direction of the sixth tube portion 117*l* is equal to or less than a critical angle of the second light guide 117*d* (sixth tube portion 117*l*). That is, the second light guide 117*d* is bent so as to totally reflect at least the light incident parallel to the extension direction of the fifth tube portion 117*k*. The second light guide 117*d* is bent so as to totally reflect the light incident parallel to the extension direction of the fifth tube portion 117*k* and reflected by the sixth tube portion 117*l* toward the fourth tube portion 117*j*. As a result, the second light guide 117*d* can efficiently guide and output the incident light.

The second sensor 118 has the same structure as the first sensor 117, and components common to each portion of the first sensor 117 is used, as each portion of the second sensor 118. However, as described with reference to FIG. 5, the light receiving element 117*b* of the first sensor 117 is located on the center side with respect to the light emitting element 117*a*, and the light receiving element 118*b* of the second sensor 118 is located on the center side with respect to the light emitting element 118*a*, in the width direction A2. Therefore, in the second sensor 118, the light emitting element 118*a* and the light receiving element 118*b* are located on the upstream side of the third hole portion 132*c* and the fourth hole portion 132*d*. The first light guide 118*c* having the lens shape is located so as to face the light emitting element 118*a*. Therefore, the first to third light guides 118*c* to 118*e* and the bond portion 118*f* of the second sensor 118 are located to be rotated by 180 degrees in parallel with the medium conveying surface with respect to the first to third light guides 117*c* to 117*e* and the bond portion 117*f* of the first sensor 117. Thus, the medium conveying apparatus 100 can share the components of the first sensor 117 and the second sensor 118, thereby reduce the apparatus cost. The components different from each portion of the first sensor 117 may be used, as each portion of the second sensor 118.

Similarly, the third sensor 119 and the fourth sensor 122 have the same structure as the first sensor 117, and components common to the first sensor 117 is used, as each portion of the third sensor 119 and the fourth sensor 122. However, as illustrated in FIG. 5, the first light guide 119*c* and the second light guide 119*d* of the third sensor 119, and the first light guide 122*c* and the second light guide 122*d* of the fourth sensor 122 are not bent. Therefore, in the third sensor 119, the light emitting element 119*a* and the light receiving element 119*b* are located at the same positions as the fifth hole portion 132*e* and the sixth hole portion 132*f* in the medium conveying direction A1. In the fourth sensor 122, the light emitting element 122*a* and the light receiving element 122*b* are located at the same positions as the seventh hole portion 132*g* and the eighth hole portion 132*h* in the medium conveying direction A1. Similar to the second sensor 118, components common to the first to second light guides 117*c* to 117*d* of the first sensor 117 may be used as the first to second light guides 119*c* to 119*d* of the third sensor 119 and the first to second light guides 122*c* to 122*d* of the fourth sensor 122.

Figure 10A:
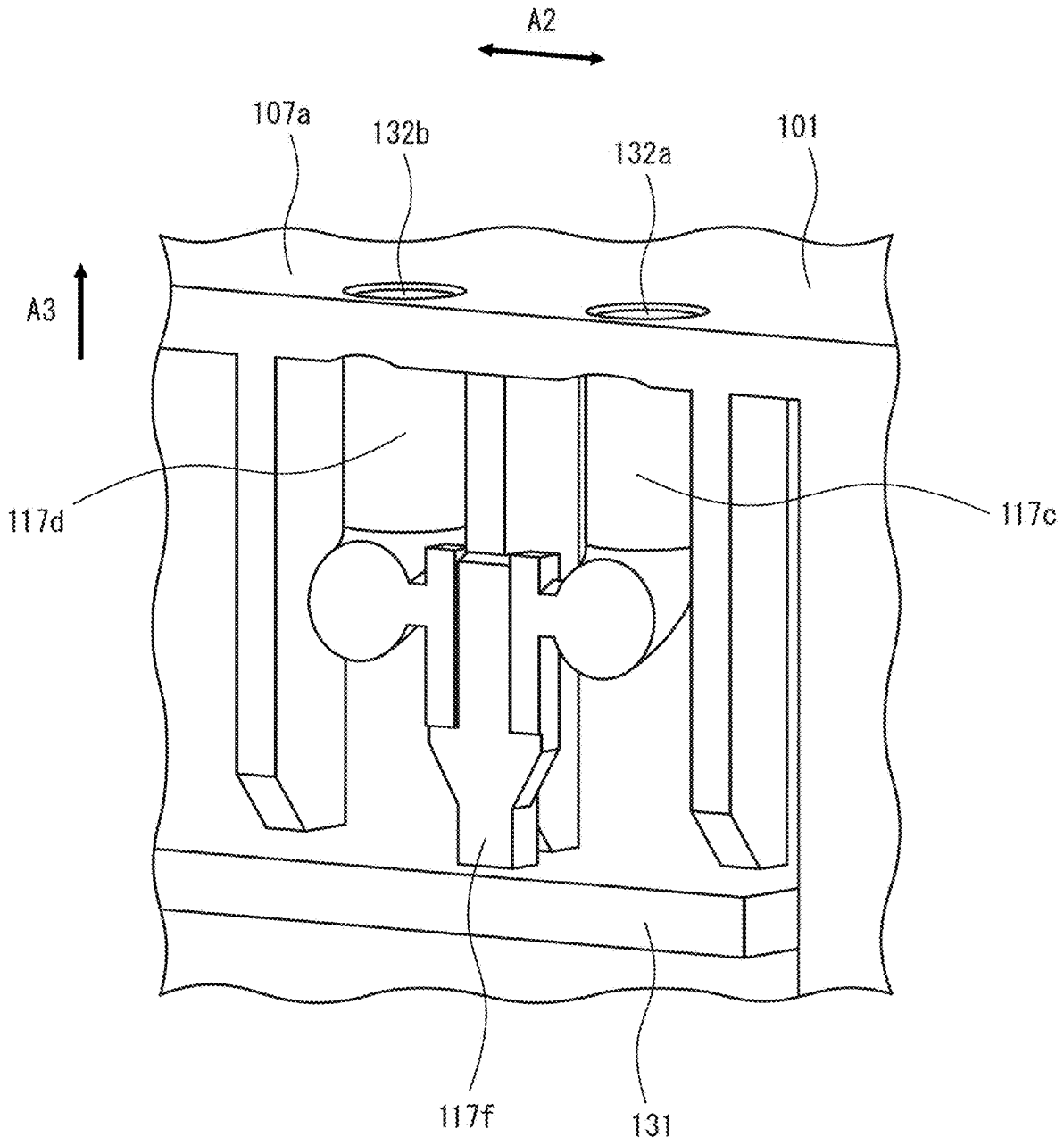
FIG. 10A is a schematic diagram for illustrating a bond member 117*f*.
Figure 10B:
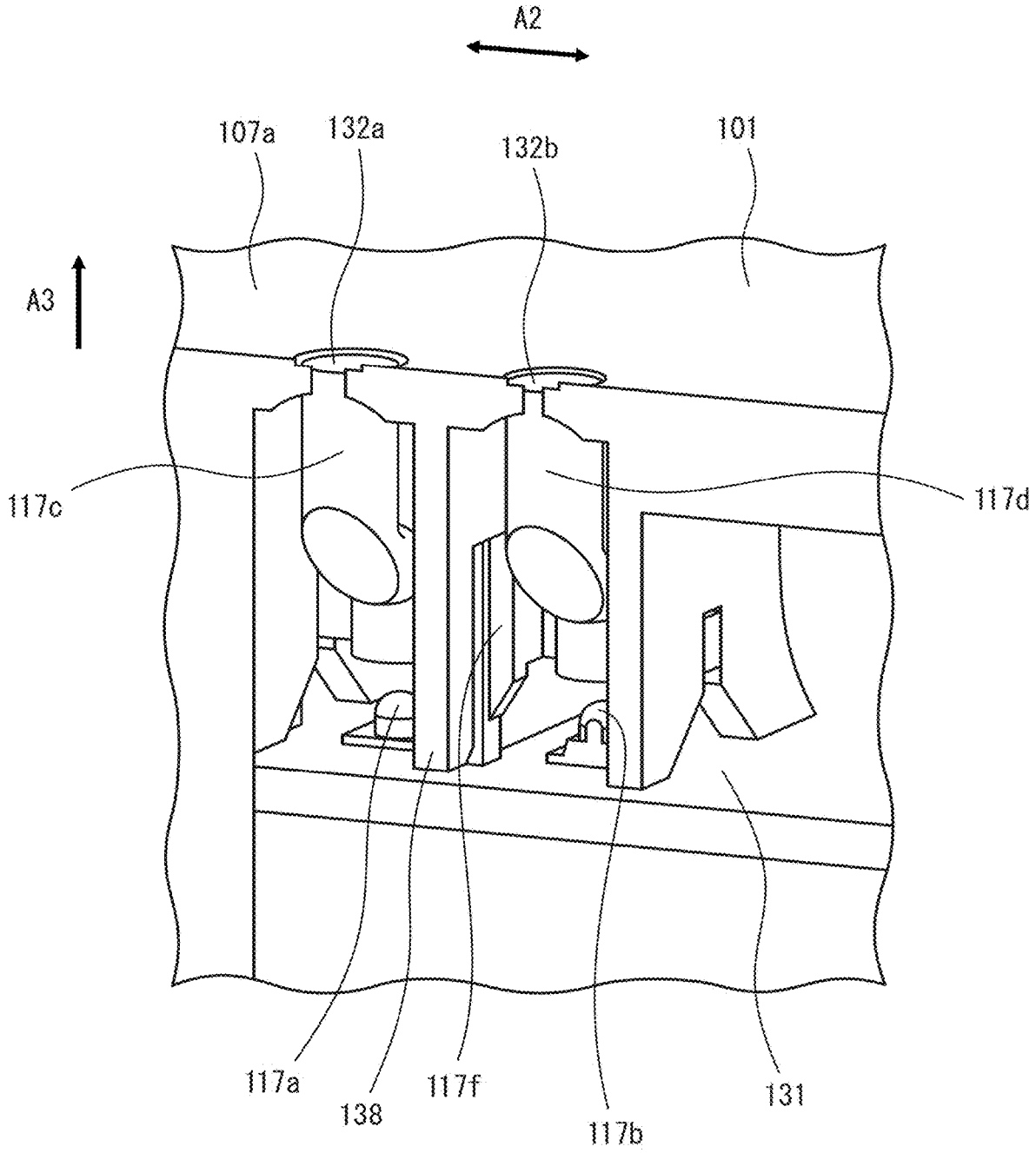
FIG. 10B is a schematic diagram for illustrating the bond member 117*f*.

FIG. 10A and FIG. 10B are schematic diagrams for illustrating the bond member 117*f*. FIG. 10A is a schematic view of a cross section acquired by cutting the lower housing 101 engaged with the first sensor 117 at a position of the bond portion 117*f*, as viewed from the downstream side. FIG. 10B is a schematic view of a cross section acquired by cutting the lower housing 101 engaged with the first sensor 117 at a position on the upstream side of the first sensor 117 from the upstream side. Since the configuration of the bond portions in the first sensor 117, the second sensor 118, the third sensor 119 and the fourth sensor 122 are the same, only the first sensor 117 will be described as a representative in the following.

As illustrated in FIG. 10A and FIG. 10B, the bond portion 117*f* is supported on the substrate 131 on which the light emitting element 117*a* and the light receiving element 117*b* are mounted. As described above, the first light guide 117*c* and the second light guide 117*d* are bonded by the bond portion 117*f* and are engaged with the first hole portion 132*a* and the second hole portion 132*b*. The first light guide 117*c* and the second light guide 117*d* are positioned in the vertical direction A3 by the bond portion 117*f*, the first hole portion 132*a*, the second hole portion 132*b* and the substrate 131, and are appropriately fixed to the lower housing 101.

In the lower housing 101, a light shielding member 138 is located between a space between the light emitting element 117*a* and the first light guide 117*c* and a space between the second light guide 117*d* and the light receiving element 117*b*. The light shielding member 138 is a plate-shaped member that does not transmit light. The light shielding member 138 prevents the diffused light emitted from the light emitting element 117*a* from leaking to the light receiving element 117*b* side and being received by the light receiving element 117*b*.

Figure 11:
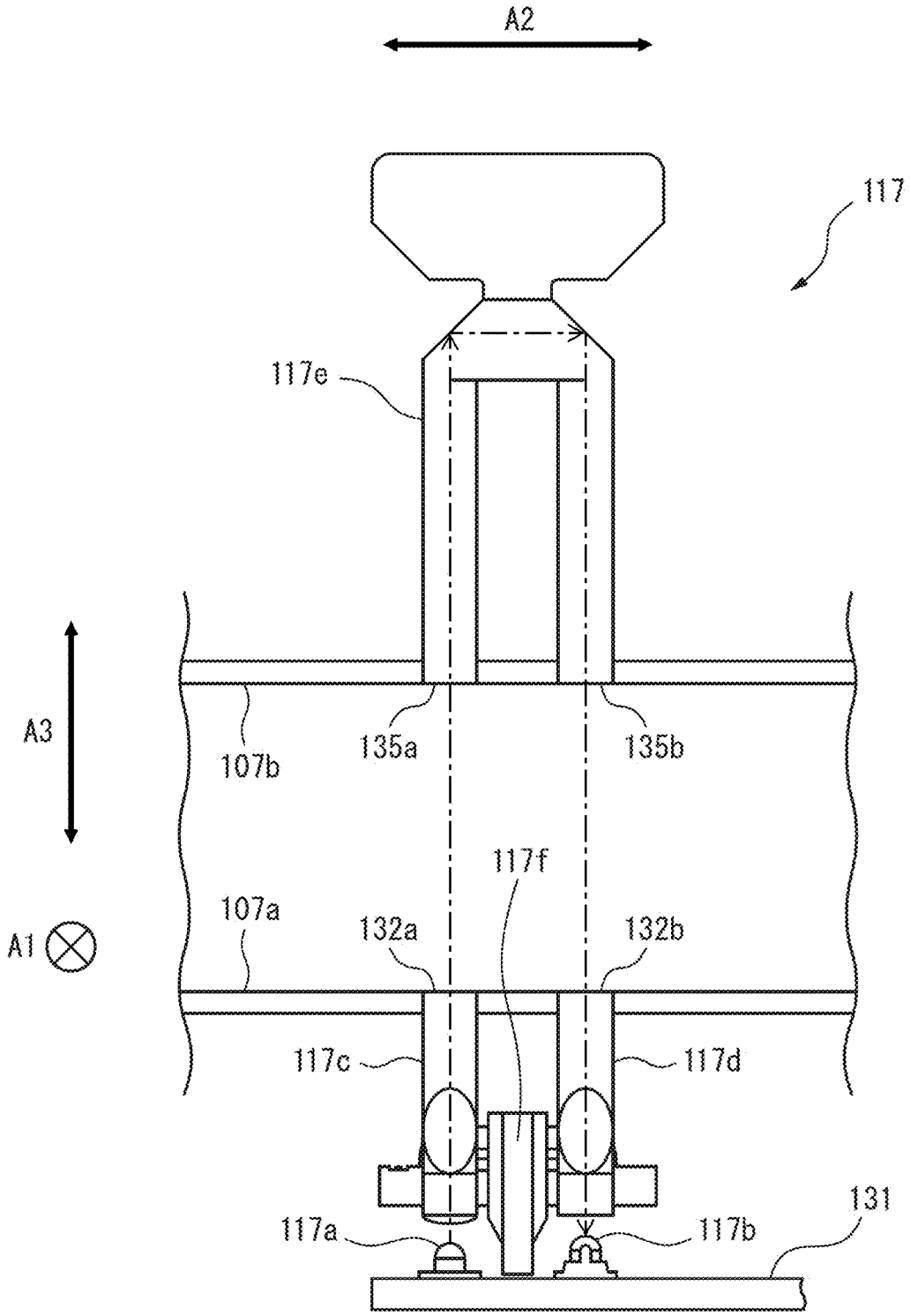
FIG. 11 is a schematic diagram for illustrating a path of light.

FIG. 11 is a schematic view for illustrating a path of light in the first sensor 117, and is a schematic view of the first sensor 117, as viewed from the upstream side. Since the paths of light in the first sensor 117, the second sensor 118, the third sensor 119 and the fourth sensor 122 are the same, only the first sensor 117 will be described as a representative in the following.

As illustrated in FIG. 11, the light emitted from the light emitting element 117*a* enters the first light guide 117*c*, and is guided to the medium conveyance path by the first light guide 117*c*. The light guided to the medium conveyance path by the first light guide 117*c* enters the lower end portion of the third light guide 117*e* facing the first light guide 117*c*, and is guided to the medium conveyance path via the lower end portion facing the second light guide 117*d* by the third light guide 117*e*. The light guided to the medium conveyance path by the third light guide 117*e* enters the second light guide 117*d*, and is guided to the light receiving element 117*b* by the second light guide 117*d*.

When the medium exists at a position facing the first sensor 117 on the medium conveyance path, the light emitted from the light emitting element 117*a* is shielded by the medium. Therefore, the signal value of the first optical signal varies between a state in which a medium exists at the position of the first sensor 117 and a state in which a medium does not exist at the position. Similarly, the signal values of the second optical signal, the third optical signal and the fourth optical signal vary between a state in which a medium exists at each position of the second sensor 118, the third sensor 119 and the fourth sensor 122 and a state in which the medium does not exist at each position.

Figure 12A:
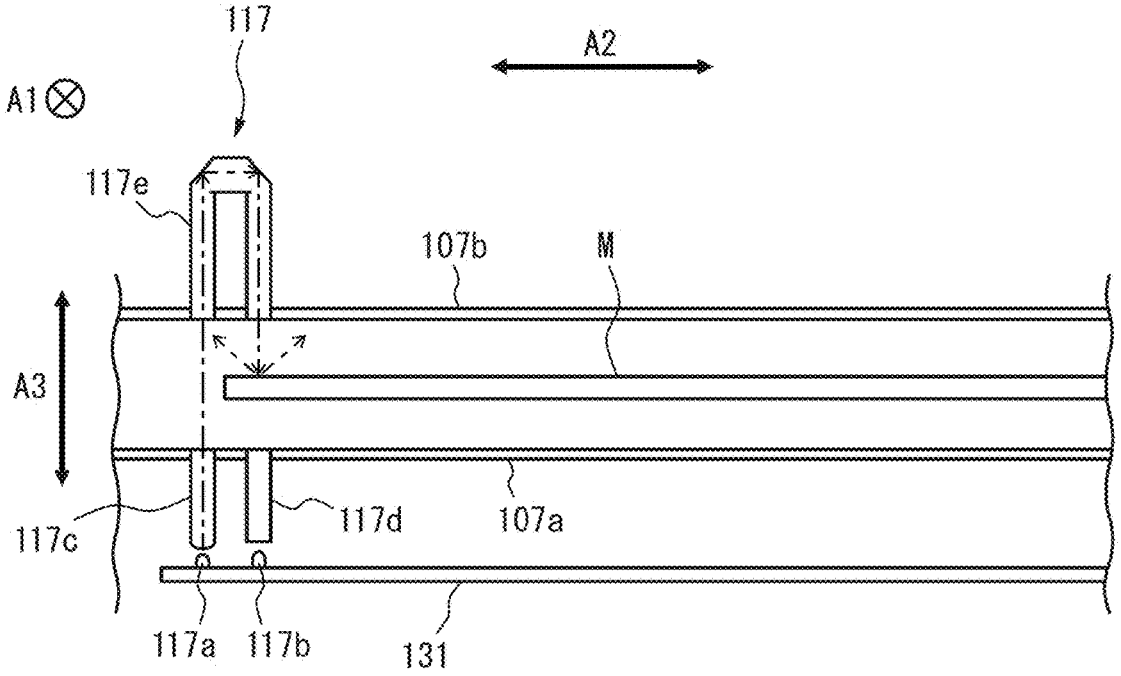
FIG. 12A is a schematic diagram for illustrating the technical significance.
Figure 12B:
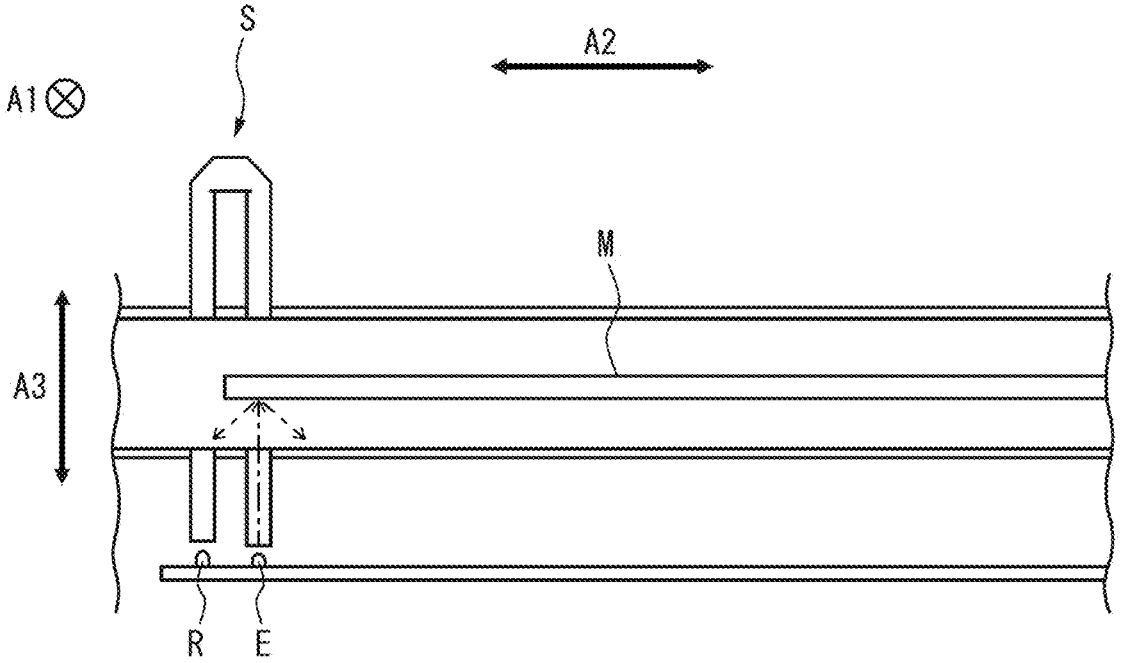
FIG. 12B is a schematic diagram for illustrating the technical significance.

FIG. 12A and FIG. 12B are schematic diagrams for illustrating the technical significance of arranging the light receiving element 117*b* (118*b*) on the center side with respect to the light emitting element 117*a* (118*a*) in the width direction A2. FIG. 12A is a schematic view of the first sensor 117, as viewed from the upstream side. FIG. 12B is a schematic view of a sensor Sin which a light receiving element R is located on the outside with respect to the light emitting element E, as viewed from the upstream side.

FIG. 12A illustrates a state in which a medium M exists at a position facing the light receiving element 117*b* of the first sensor 117, and the medium M does not exist at a position facing the light emitting element 117*a* located on the outside with respect to the light receiving element 117*b*. FIG. 12B illustrates a state in which the medium M exists at a position facing the light emitting element E of the sensor S, and the medium M does not exist at a position facing the light receiving element R located on the outside with respect to the light emitting element E.

As illustrated in FIG. 12A and FIG. 12B, the medium M may exist only at the inner position, and not exist at the outer position among the positions facing the light emitting element and the light receiving element when the medium M is conveyed inclined, or when a size of the medium M is small, etc. As illustrated in FIG. 12B, the medium M may exist at a position facing the light emitting element E, and not exist at a position facing the light receiving element R when the light receiving element R is located on the outside of the light emitting element E. In that case, the light emitted from the light emitting element E and guided by the light guide facing the light emitting element E, is shielded by the medium M in the medium conveyance path, and does not reach a light guide located on the upper side. However, the light may be reflected by the medium M, enter the light guide facing the light receiving element R, and reach the light receiving element R. In that case, the medium conveying apparatus erroneously determines that the medium M does not exist at the position of the sensor S, even though the medium M exists at the position of the sensor S.

On the other hand, as illustrated in FIG. 12A, in the medium conveyance device 100, the light receiving element 117*b* is located on the center side with respect to the light emitting element 117*a* in the width direction A2. In this case, the light emitted from the light emitting element 117*a* and guided by the first light guide 117*c* is further guided by the third light guide 117*e*, and is emitted from the third light guide 117*e* to the medium conveyance path. Even when the light is reflected by the medium M, the light does not reach the light receiving element 117*b* since the light is reflected upward. Therefore, the medium conveying apparatus 100 can suppress erroneous determination that the medium M does not exist at the position of the first sensor 117 even though the medium M exists at the position of the first sensor 117.

Figure 13A:
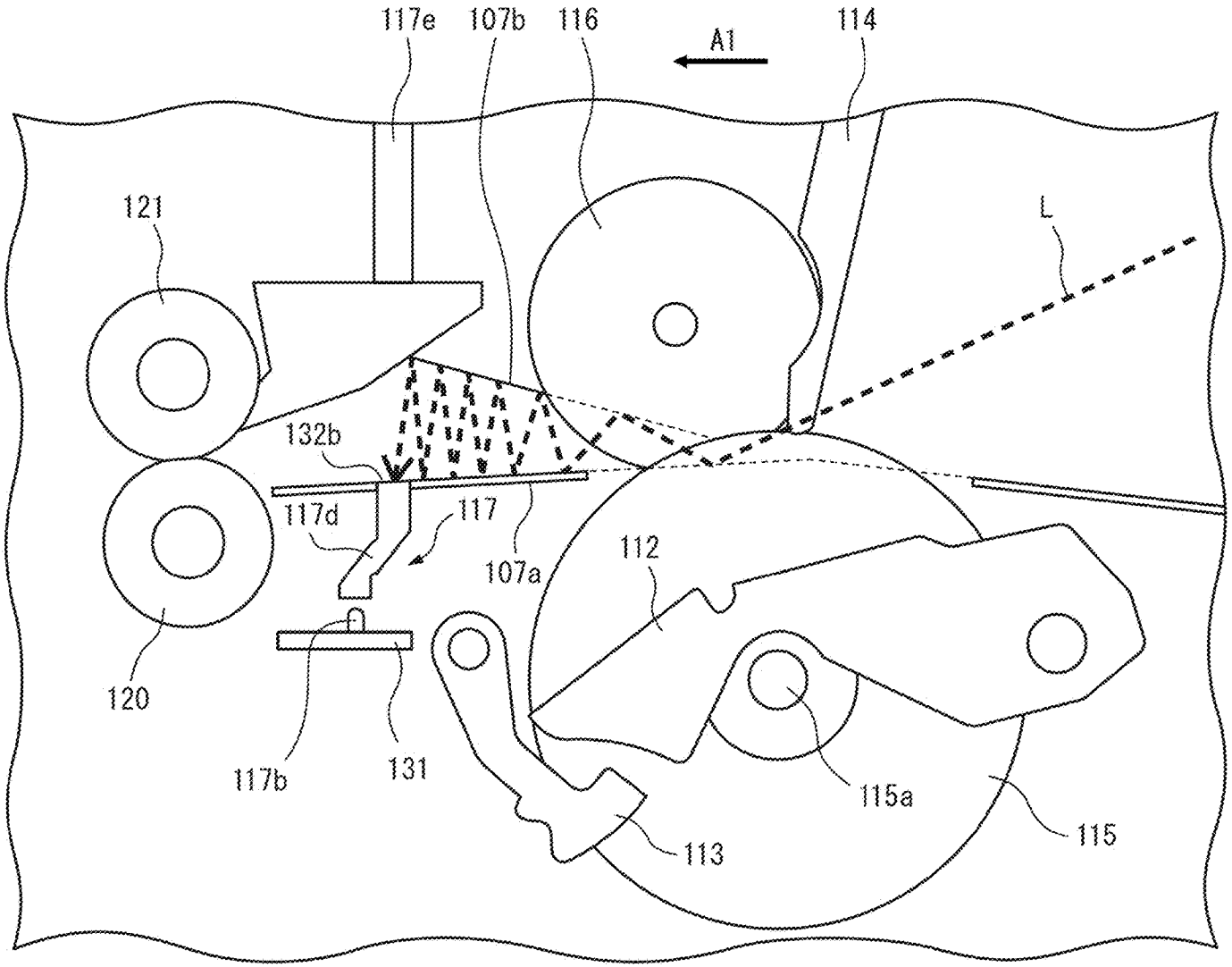
FIG. 13A is a schematic diagram for illustrating the technical significance.
Figure 13B:
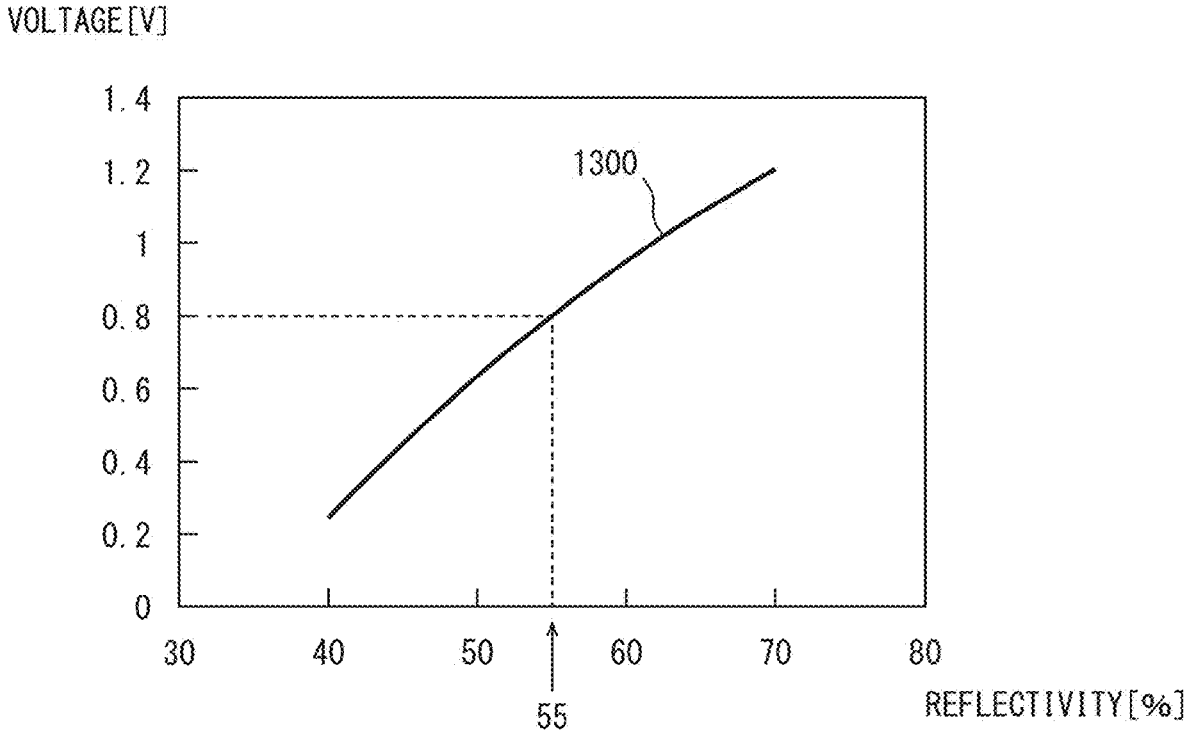
FIG. 13B is a schematic diagram for illustrating the technical significance.

FIG. 13A and FIG. 13B are schematic diagrams for illustrating the technical significance of setting the reflectivity in the periphery of each hole of the lower guide 107*a* and the upper guide 107*b* to 55% or less. FIG. 13A is a schematic diagram of the medium conveyance path, as viewed from the side. FIG. 13B is a graph illustrating a relation between the reflectivity in the periphery of each hole of the lower guide 107*a* and the upper guide 107*b*, and an amount of the light received by the light receiving device 117*b*.

As described above, in the medium conveying apparatus 100, the lower guide 107*a* and the upper guide 107*b* are located so as to be apart from each other by a predetermined distance or more so as to convey a passport. Therefore, as illustrated in FIG. 13A, the disturbing light L entering from the medium conveyance port or the discharge port may enter the second hole portion 132*b* facing the second light guide 117*d* for guiding the light to the light receiving device 117*b* while being reflected between the lower guide 107*a* and the upper guide 107*b*. Also, when a medium such as a paper is conveyed, and a part of the medium is bent, curled, or raised during conveyance, the disturbing light L entering from the medium conveying port or the ejection port may enter into the medium conveyance path through the gap. In this case, there is a possibility that the disturbing light L entering from the medium conveying port or the ejection port enters the second hole portion 132*b* while being reflected between the medium and the lower guide 107*a* or the upper guide 107*b*.

The largest amount of light received by the light receiving element 117*b* during conveyance among the media supported by the medium conveying apparatus 100, is a transparent carrier sheet. In the medium conveying apparatus 100, the amount of the light received by the light receiving element 117*b* when the transparent carrier sheet is conveyed as the medium is substantial ½ of an amount of a light received when the medium is not conveyed. As described above, the first optical signal, for example, is generated so that the signal value is proportional to the amount of the light received in the light receiving element 117*b*. For example, when the light emission amount of the light emitting element 117*a* is adjusted so that the signal value of the first optical signal is 2.4 [V] in a state in which a medium is not conveyed, the signal value of the first optical signal is 1.2 [V] in a state in which the carrier sheet is conveyed.

In the medium conveying apparatus 100, a determination threshold that is compared with the first optical signal for determining whether or not a medium exists is set to a value between a signal value of the first optical signal in a state in which a medium is not conveyed and a signal value of the first optical signal in a state in which the transparent carrier sheet is conveyed. That is, the determination threshold is set to a value between the signal value of the first optical signal in a state in which the medium is not conveyed and a value of ½ of that signal value.

The medium conveying apparatus 100 adjusts the light emission amount of the light emitting element 117*a* immediately after starting the apparatus in consideration of an influence of an ambient light in an installation environment. The medium conveying apparatus 100 causes the light emitting element 117*a* to emit the light in a state in which the medium is not conveyed immediately after starting the apparatus, and causes the light receiving element 117*b* to generate the first optical signal. The medium conveying apparatus 100 adjusts the light emission amount of the light emitting element 117*a* so that the signal value of the first optical signal is a predetermined value (e.g., 2.4 [V]). However, when the disturbing light enters the medium conveyance path during adjusting the light emission amount, the light emission amount is adjusted so that the signal value of the first optical signal is the predetermined value in a state in which the disturbing light is applied. Thereafter, in the medium conveying apparatus 100, if the presence or absence of the medium is determined in a state with no disturbing light entering, the signal value of the first optical signal generated by the light receiving element 117*b* with the light emitting element 117*a* emitting the adjusted light emission amount of light is less than the predetermined value.

Therefore, the determination threshold is preferably set to a value less than an average value of the signal value (a predetermined value) of the first optical signal during adjusting the light emission amount and a value of ½ of that signal value, in consideration of the possibility that the disturbing light enters the medium conveyance path during adjusting the light emission amount. For example, the determination threshold is set to a value (e.g., 1.6 [V]) of ⅔ of the signal value (a predetermined value) of the first optical signal during adjusting the light emission amount of the light emitting element 117*a*.

A graph 1300 illustrated in FIG. 13B illustrates a measured results of the signal value of the first optical signal when the disturbing light enters from the medium conveying port of the medium conveying apparatus while changing the respective guides so that the color in the periphery of the respective hole portions of the lower guide and the upper guide of the medium conveying apparatus are different. The horizontal axis of the graph 13B indicates a reflectivity of each guide, the vertical axis indicates the signal value of the first optical signal with the disturbing light entering. As illustrated in the graph 1300, the higher the reflectivity of each guide, the larger the signal value of the first optical signal with the disturbing light entering, and the lower the reflectivity of each guide, the smaller the signal value of the first optical signal with the disturbing light entering.

As described above, when the signal value (a predetermined value) of the first optical signal during adjusting the emission amount is 2.4 [V], and the determination threshold is 1.6 [V] which is a value of ⅔ of the signal value, the difference is 0.8 [V]. When the amount of the received light by the disturbing light during adjusting the emission amount exceeds 0.8 [V], the signal value of the first light signal generated by the light receiving element 117*b* when the light emitting element 117*a* emits the adjusted emission amount of light with no disturbing light entering, is lower than the determination threshold. In that case, the medium conveying apparatus 100 cannot correctly determine whether or not the medium exists. Therefore, the signal value of the first optical signal with the disturbing light entering needs to be suppressed to 0.8 [V] or less. The reflectivity of each guide is preferably set to 55% or less so that the signal value of the first optical signal with the disturbing light entering is 0.8 [V] or less.

That is, the reflectivity of each guide is preferably set so that the signal value of the first optical signal with the disturbing light entering is equal to or less than a difference between the signal value of the first optical signal in a state in which a medium is not conveyed in an environment in which the disturbing light does not exist, and the determination threshold. As described above, the reflectivity of each guide is set to 55% or less when the signal value of the first optical signal in a state the medium is not conveyed in an environment in which the disturbing light does not exist is 2.4 [V] and the determination threshold is 1.6 [V] which is a value of ⅔ of that signal value.

As described above, the amount of the light received in the light receiving element 117*b* in a state in which the transparent carrier sheet is conveyed as a medium is about ½ of the amount of the received light in a state in which the medium is not conveyed, and the signal value of the first optical signal is 1.2 [V]. If the determination threshold is set to the average value of the signal value of the first optical signal in a state in which the medium is not conveyed in an environment in which the disturbing light does not exist and the signal value of the first optical signal in a state in which the transparent carrier sheet is conveyed as the medium, the determination threshold is set to 1.8 [V]. In that case, as the signal value of the first optical signal with the disturbing light entering is 0.6 [V] or less, the reflectivity of each guide is preferably set to 50% or less.

As described above, in the medium conveying apparatus 100, the lower guide 107*a* and the upper guide 107*b* are located so as to be apart from each other by a predetermined distance or more so as to convey a passport. Therefore, in the medium conveying apparatus 100, it is likely that the light emitted from the light emitting element 117*a* and not passing through the third light guide 117*e* is reflected by the upper guide 107*b* and/or the lower guide 107*a* and erroneously enters the light receiving element 117*b* as an internal disturbing light. The medium conveying apparatus 100 can also suppress the internal disturbing light from being erroneously incident on the light receiving element 117*b* by lowering the reflectivity of each guide.

Figure 14:
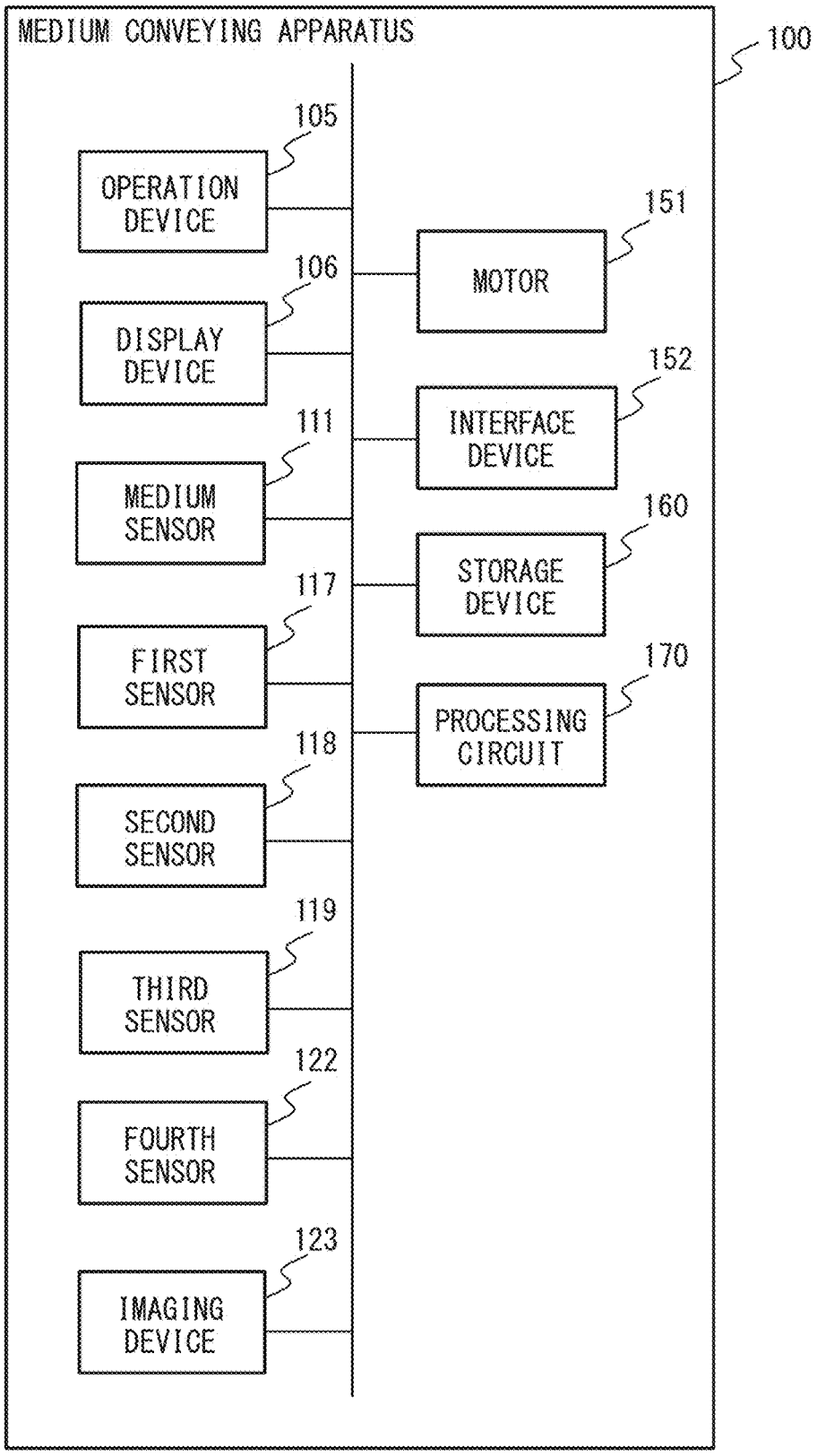
FIG. 14 is a block diagram illustrating a schematic configuration of a medium conveying apparatus 100.

FIG. 14 is a block diagram illustrating a schematic configuration of a medium conveying apparatus 100.

The medium conveying apparatus 100 further includes a motor 151, an interface device 152, a storage device 160, and a processing circuit 170, etc., in addition to the configuration described above.

The motor 151 has one or more motors rotates the moving mechanism 113 to move the set guide 112 by a control signal from the processing circuit 170. Further, the motor 151 rotates the feed roller 115, the brake roller 116, and the first to fourth conveying rollers 120, 121, 124 and 125 to feed and convey the medium by a control signal from the processing circuit 170.

For example, the interface device 152 includes an interface circuit conforming to a serial bus such as universal serial bus (USB), is electrically connected to an unillustrated information processing device (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 152. For example, the predetermined communication protocol is a wireless local area network (LAN).

The storage device 160 includes a memory device such as a random access memory (RAM) or a read only memory (ROM), a fixed disk device such as a hard disk, or a portable storage device such as a flexible disk or an optical disk. Further, the storage device 160 stores a computer program, a database, a table, etc., used for various types of processing in the medium conveying apparatus 100. The computer program may be installed on the storage device 160 from a computer-readable, non-transitory portable recording medium such as a compact disc read only memory (CD-ROM), a digital versatile disc read only memory (DVD-ROM), etc., by using a well-known setup program, etc.

The processing circuit 170 operates in accordance with a program previously stored in the storage device 160. The processing circuit 170 is, for example, a CPU (Central Processing Unit). The processing circuit 170 may be a digital signal processor (DSP), a large scale integration (LSI), an application specific integrated circuit (ASIC), a field-programmable gate array (FPGA), etc.

The processing circuit 170 is connected to the operation device 105, the display device 106, the medium sensor 111, the first sensor 117, the second sensor 118, the third sensor 119, the fourth sensor 122, the imaging device 123, the motor 151, the interface device 152 and the storage device 160, and controls each of these unit. The processing circuit 170 performs drive control of the motor 151, imaging control of the imaging device 123, etc., controls the conveyance of the medium, generates an input image, and transmits the input image to the information processing apparatus via the interface device 152.

Figure 15:
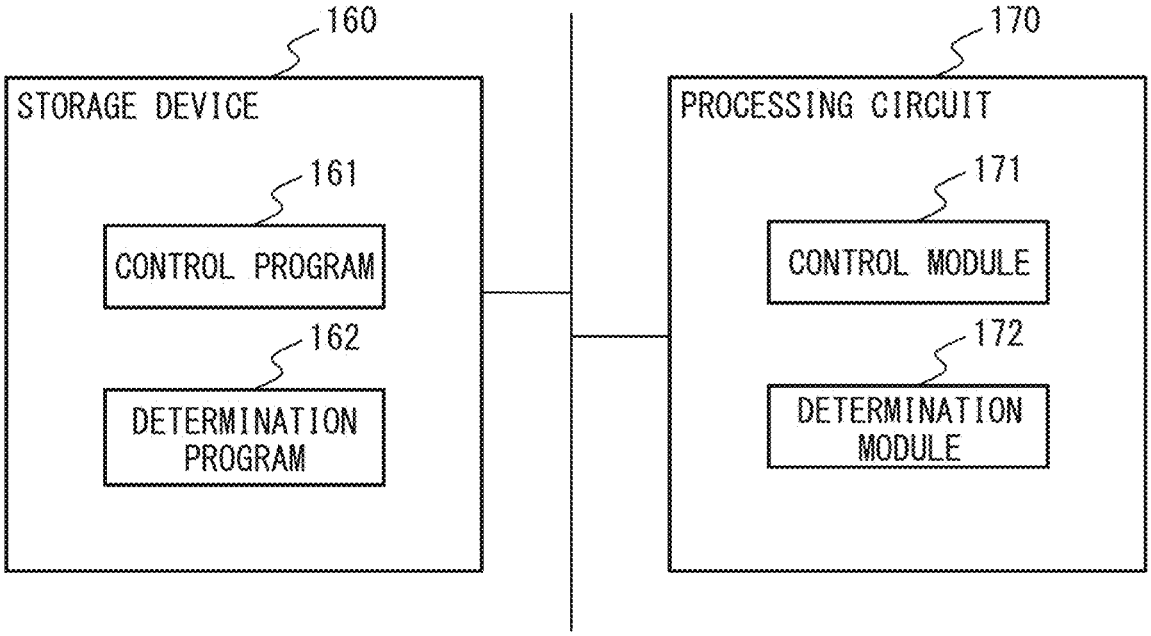
FIG. 15 is a diagram illustrating schematic configurations of a storage device 160 and a processing circuit 170.

FIG. 15 is a diagram illustrating schematic configurations of a storage device 160 and a processing circuit 170.

As illustrated in FIG. 15, a control program 161 and a determination program 162, etc., are stored in the storage device 160. Each of these programs is a functional module implemented by software operating on a processor. The processing circuit 170 reads each program stored in the storage device 160 and operates in accordance with each read program. Thus, the processing circuit 170 functions as a control module 171 and a determination module 172.

Figure 16:
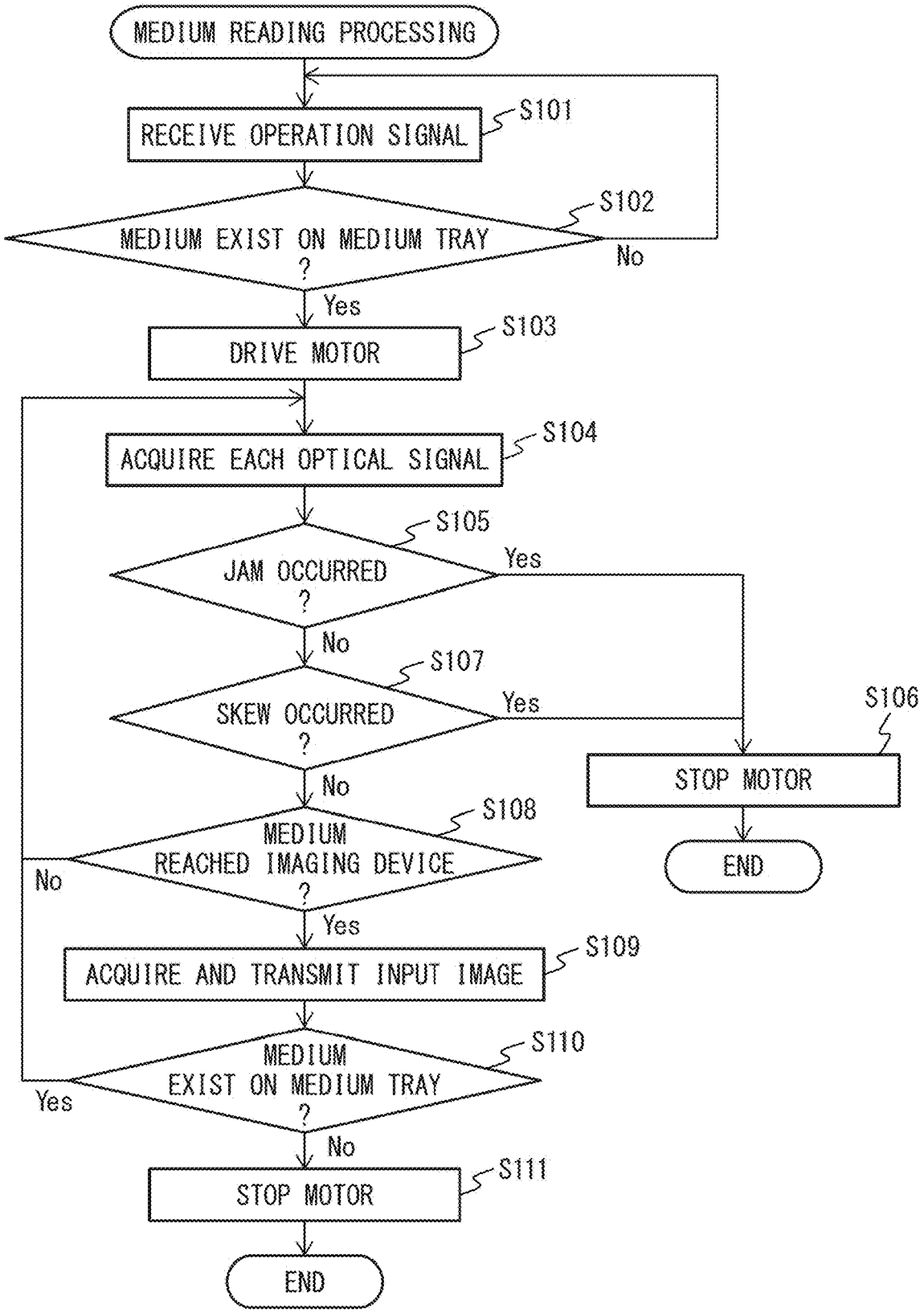
FIG. 16 is a flowchart illustrating an operation example of a medium reading processing.

FIG. 16 is a flowchart illustrating an operation example of the medium reading process in the medium conveying apparatus 100.

Referring to the flowchart illustrated in FIG. 16, an operation example of the skew detection processing in the medium conveying apparatus 100 will be described below. The operation flow described below is executed mainly by the processing circuit 170 in cooperation with each element in the medium conveying apparatus 100, in accordance with a program previously stored in the storage device 160. The operation flow illustrated in FIG. 16 is periodically executed.

First, the control module 171 stands by until an instruction to read a medium is input by a user by use of the operation device 105, and an operation signal instructing to read the medium is received from the operation device 105 (step S101).

Next, the control module 171 acquires the medium signal from the medium sensor 111, and determines whether or not the medium is placed on the medium tray 103 based on the acquired medium signal (step S102).

When a medium is not placed on the medium tray 103, the control module 171 returns the processing to step S101 and stands by until newly receiving an operation signal from the operation device 105.

On the other hand, if the medium is placed on the medium tray 103, the control module 171 drives the motor 151 (step S103). The control module 171 drives the motor 151 to rotate the moving mechanism 113 to move the set guide 112 to the release position, thereby enable feeding of the medium. Further, the control module 171 drives the motor 151 to rotate the feed roller 115, the brake roller 116, and the first to fourth conveying rollers 120, 121, 124 and 125 to feed and convey the medium.

Next, the determination module 172 receives the first optical signal, the second optical signal, the third optical signal and the fourth optical signal, respectively, from the first sensor 117, the second sensor 118, the third sensor 119 and the fourth sensor 122 (step S104).

Next, the determination module 172 determines whether or not the jam of the medium has occurred based on the first optical signal, the second optical signal and the third optical signal received from the first sensor 117, the second sensor 118 and the third sensor 119 (step S105).

The determination module 172 determines whether or not the front end of the medium has reached either of the positions of the first sensor 117, the second sensor 118 and the third sensor 119. The determination module 172 determines that the front end of the medium has reached the position of the sensor outputting each optical signal when the signal value of each optical signal changes from a value indicating that a medium does not exist to a value indicating that a medium exists. That is, the determination module 172 determines the front end of the medium has reached the position of the sensor outputting the optical signal when the signal value of each optical signal received immediately before is equal to or more than the determination threshold and the signal value of the optical signal received newly is less than the determination.

The determination module 172 determines that the jam of the medium has occurred when the front end of the medium has not reached any position of the first sensor 117, the second sensor 118 and the third sensor 119 even when a first predetermined time has elapsed since the start of feeding the medium. On the other hand, the determination module 172 determines that the jam of the medium has not occurred when the front end of the medium has reached the position of any of the sensors before the first predetermined time has elapsed since the start of feeding the medium. Further, the determination module 172 determines that the jam of the medium has not occurred when the first predetermined time has not yet elapsed since the start of feeding the medium.

Thus, the determination module 172 determines whether or not the jam of the medium has occurred based on the signal output from the light receiving element 117*b*, the light receiving element 118*b* and the light receiving element 119*b*. The determination module 172 may determine whether or not the jam of the medium has occurred based on only at least one signal of the first optical signal, the second optical signal and the third optical signal.

When the jam of the medium has occurred, the control module 171 stops the motor 151 to stop feeding and conveying the medium (step S106), and terminates the series of steps. The control module 171 can suppress the medium from being damaged by stopping the feeding and conveying the medium when the jam of the medium has occurred. Further, the control module 171 notifies the user of a warning by displaying information indicating that an abnormality has occurred on the display device 106 or transmitting the information to the information processing device via the interface device 152.

On the other hand, when the jam of the medium has not occurred, the control module 171 determines whether or not the skew of the medium has occurred based on the first optical signal, the second optical signal and the third optical signal, respectively, received from the first sensor 117, the second sensor 118 and the third sensor 119 (step S107).

The determination module 172, in a manner similar to the processing of step S105, determines whether or not the front end of the medium has reached each of positions of the first sensor 117, the second sensor 118 and the third sensor 119. The determination module 172 determines that the skew of the medium has occurred when a second predetermined time has elapsed since the front end of the medium reaches the position of any of the sensors, and the front end of the medium has not reached the position of the other sensor. On the other hand, the determination module 172 determines that the skew of the medium has not occurred when the front end of the medium reaches the position of the other sensor before the second predetermined time has elapsed since the front end of the medium reaches the position of any of the sensors. Further, the determination module 172 determines that the skew of the medium has not occurred when the second predetermined time has not yet elapsed since the front end of the medium reached the position of any of the sensors.

Thus, the determination module 172 determines whether or not the skew of the medium has occurred based on the signal output from the light receiving element 117*b*, the light receiving element 118*b* and the light receiving element 119*b*. The determination module 172 may determine whether or not the skew of the medium has occurred based on only any two signals of the first optical signal, the second optical signal and the third optical signal. Further, the determination module 172 may acquire the input image from the imaging device 123, and determine whether or not the skew of the medium has occurred further based on the acquired input image. In that case, the determination module 172 determines whether or not the input image includes the medium using a known image processing technique. The determination module 172 determines that the skew of the medium has occurred when a medium is included in the input image acquired from the imaging device 123 before the front end of the medium reaches each of the positions of the first sensor 117, the second sensor 118 and the third sensor 119. In this case, the determination module 172 may determine whether or not the skew of the medium has occurred based on any one signal of the first optical signal, the second optical signal and the third optical signal, and the input image.

When the skew of the medium has occurred, the control module 171 stops the motor 151 to stop feeding and conveying the medium (step S106), and terminates the series of steps. The control module 171 can suppress the medium from being damaged by stopping feeding and conveying the medium when the skew of the medium has occurred. Further, the control module 171 notifies the user of a warning by displaying information indicating that an abnormality has occurred on the display device 106 or transmitting the information to the information processing device via the interface device 152.

On the other hand, when the skew of the medium has not occurred, the control module 171 determines whether or not the front end of the medium has reached the position of the imaging device 123 based on the fourth optical signal received from the fourth sensor 122 (step S108).

The determination module 172 determines the front end of the medium has reached the position of the fourth sensor 122 when the signal value of the fourth optical signal changes from a value indicating that a medium does not exist to a value indicating that a medium exists. That is, the determination module 172 determines that the front end of the medium has reached the position of the fourth sensor 122 when the signal value of the fourth optical signal received immediately before is the determination threshold or more and the signal value of the fourth optical signal received newly is less than the determination threshold. The determination module 172 determines that the front end of the medium has reached the position of the imaging device 123 when a third predetermined time has elapsed since the front end of the medium reaches the position of the fourth sensor 122.

When the front end of the medium has not reached the position of the imaging device 123, the determination module 172 returns the processing to step S104, and repeats the processing of step S104 to S108 (step S108).

On the other hand, when the front end of the medium has reached the position of the imaging device 123, the control module 171 causes the imaging device 123 to start imaging the medium, to acquire the input image from the imaging device 123. The control module 171 transmits the acquired input image to the information processing device via the interface device 152 (step S109).

Next, the control module 171 determines whether or not the medium remains on the medium tray 103 based on the medium signal acquired from the medium sensor 111 (step S110). When a medium remains on the medium tray 103, the control module 171 returns the processing to step S104 and repeats the processing in steps S104 to S110.

On the other hand, when the medium does not remain on the medium tray 103, the control module 171 stops the motor 151 (step S111), and ends the series of steps.

Any one of the processing of step S105 and step S107 may be omitted.

As described in detail above, in the medium conveying apparatus 100, the reflectivity in the periphery of the hole portions for guiding the light emitted from each light emitting element of the first to fourth sensors 117, 118, 119 and 122 located on the medium conveyance path to each light receiving element is equal to or less than a predetermined ratio. Thus, the medium conveying apparatus 100 can suppress the erroneous determination that the medium does not exist, by the disturbing light, even though the medium exists. Therefore, the medium conveying apparatus 100 can detect the medium more accurately using the light emitting element and the light receiving element.

In the medium conveying apparatus 100, the first hole portion 132*a* and the second hole portion 132*b* are provided between the feed roller 115, and the first conveying roller 120 and the second conveying roller 121 to detect the medium. On the other hand, the light emitting element 117*a* and the light receiving element 117*b* are provided on the downstream side of the first hole portion 132*a* and the second hole portion 132*b* so as to avoid the moving mechanism 113 of the set guide 112. The first light guide 117*c* and the second light guide 117*d* which are the prisms for guiding the light emitted from the light emitting element 117*a* to the light receiving element 117*b*, are bent between the first hole portion 132*a* and the second hole portion 132*b*, and the light emitting element 117*a* and the light receiving element 117*b*. Thus, the medium conveying apparatus 100 can detect the medium passing through the feed roller 115 as early as possible, while effectively utilizing the space in the housing. Therefore, in the medium conveying apparatus 100, the light emitting element 117*a* and the light receiving element 117*b* can be appropriately located.

While a preferred embodiment of the medium conveying apparatus 100 has been described above, the medium conveying apparatus 100 is not limited to the above described embodiment. For example, in the medium conveying direction A1, the first light guide and the second light guide of the first sensor 117 and the second sensor 118 may not be bent, and the light emitting element and the light receiving element may be located at the same position as the corresponding hole portion. The lower guide 107*a* and the upper guide 107*b* may be provided so that the reflectivity in the periphery of each hole is less than 55%.

Further, in the first sensor 117, the second sensor 118, the third sensor 119 and/or the fourth sensor 122, the light emitting element, the light receiving element, the first light guide and the second light guide are located in the upper housing 102, and the third light guide may be located in the lower housing 101. In this case, the upper guide 107*b* is an example of a first guide, and the lower guide 107*a* is an example of a second guide. Also, in this case, the lower guide 107*a* and the upper guide 107*b* are provided with holes that engage with end portions of respective light guides, and the lower guide 107*a* and the upper guide 107*b* are provided so that a reflectivity in a periphery of each hole portion is 55% or less. Further, in this case, the set guide 112, the moving mechanism 113 and the feed roller 115 may be located in the upper housing 102, and the flap 114 and the brake roller 116 may be located in the lower housing 101.

Further, in the first sensor 117, the second sensor 118, in the third sensor 119 and/or the fourth sensor 122, a reflecting member such as a mirror may be used instead of the third light guide. The third light guide may be omitted, and the medium conveying apparatus 100 may determine whether or not a medium exists, by determining whether or not the light emitted from the light emitting element is reflected by the medium or reflected by the guide facing the light emitting element based on the signal value of the optical signal output from each light receiving element. Further, in the first sensor 117, the second sensor 118, the third sensor 119 and/or the fourth sensor 122, the first light guide and/or the second light guide may be omitted, the light emitting element and/or the light receiving element may be located in the vicinity of the corresponding hole portion.

Figure 17:
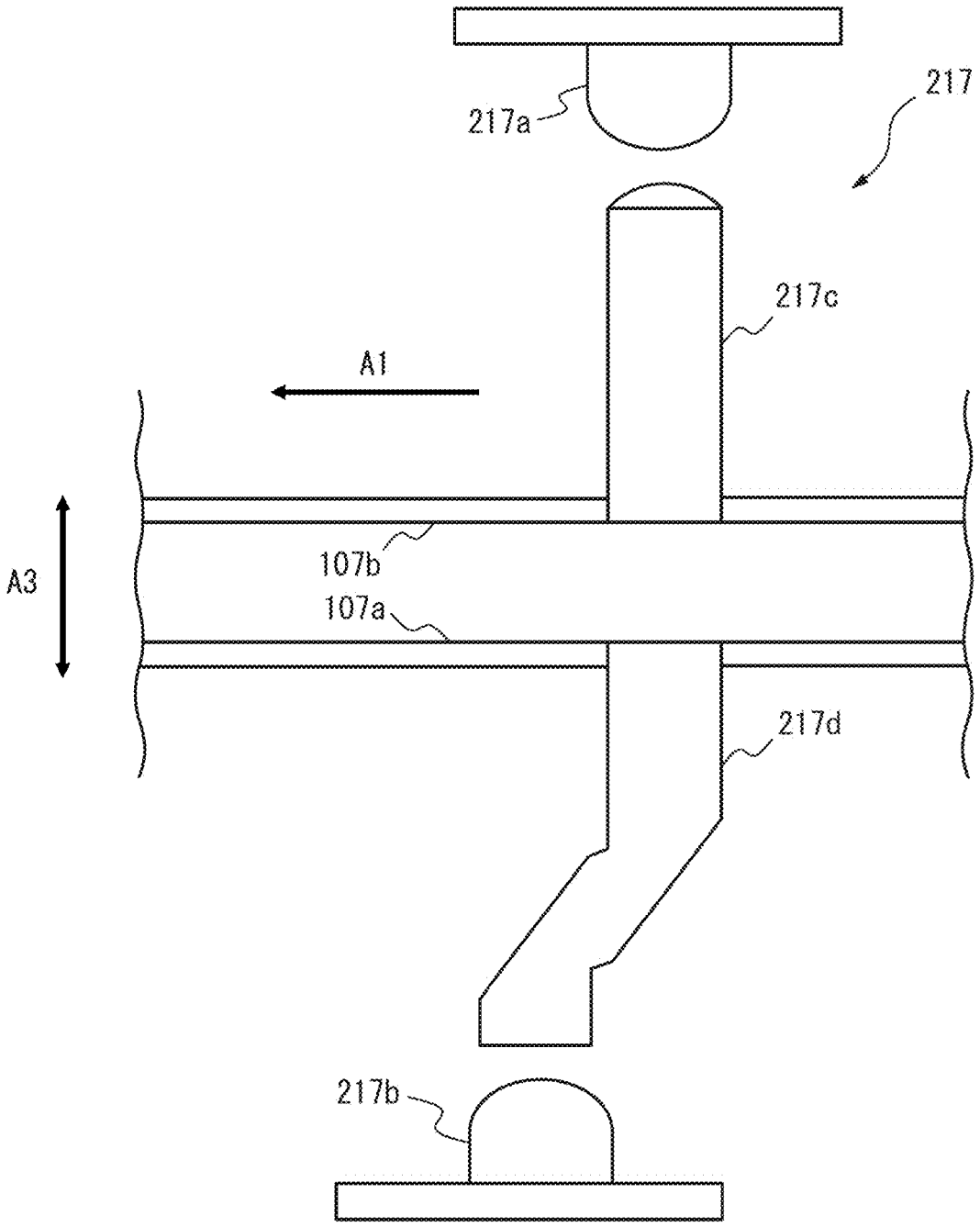
FIG. 17 is a schematic diagram for illustrating an arrangement of other light emitting element and the light receiving element.

FIG. 17 is a schematic diagram for illustrating an arrangement of a light emitting element and a light receiving element in a medium conveying apparatus according to another embodiment.

As illustrated in FIG. 17, in the medium conveying apparatus according to the present embodiment, the first sensor 217 is used instead of the first sensor 117. The first sensor 217 includes a light emitting element 217*a*, a light receiving element 217*b*, a first light guide 217*c*, and a second light guide 217*d*, etc. Configurations of the light emitting element 217*a*, the light receiving element 217*b*, the first light guide 217*c* and the second light guide 217*d* are similar to those of the light emitting element 117*a*, the light receiving element 117*b*, the first light guide 117*c* and the second light guide 117*d* of the first sensor 117.

However, the light emitting element 217*a* and the first light guide 217*c* are located on the outside of the medium conveyance path with the upper guide 107*b* in between. That is, the light emitting element 217*a* is located so as to face the upper end portion of the first light guide 217*c*, to emit the light toward the upper end portion of the first light guide 217*c*. The first light guide 217*c* is provided in the upper housing 102 so that an upper end portion thereof faces the light emitting element 217*a* and a lower end portion thereof faces an upper end portion of the second light guide 117*d* with the medium conveyance path in between, to guide the light emitted from the light emitting element 217*a* to the medium conveyance path. The second light guide 217*d* is provided in the lower housing 101 so that an upper end portion thereof faces the lower end portion of the first light guide 217*c* with the medium conveyance path in between, and a lower end portion thereof faces the light receiving element 217*b*, to guide the light incident from the medium conveyance path to the light receiving element 217*b*.

Similarly, a light emitting element and a first light guide of a second sensor, a third sensor and/or a fourth sensor may also be located on the outside of the medium conveyance path with the upper guide 107*b* in between. Further, in the first sensor, the second sensor, the third sensor and/or the fourth sensor, the light receiving element and the second light guide may be located in the upper housing 102, the light emitting element and the first light guide may be located in the lower housing 101. In this case, the upper guide 107*b* is an example of a first guide, and the lower guide 107*a* is an example of a second guide. Also in these cases, the lower guide 107*a* and the upper guide 107*b* are provided with hole portions engaging with end portions of respective light guides, and the lower guide 107*a* and the upper guide 107*b* are provided so that the reflectivity in a periphery of the hole portions engaged with the second light guide is 55% or less. Further, in the first sensor, the second sensor, the third sensor and/or the fourth sensor, the first light guide and/or the second light guide may be omitted, and the light emitting element and/or the light receiving element may be located in the vicinity of the corresponding hole portions.

As described in detail above, the medium conveying apparatus can detect the medium more accurately using the light emitting element and the light receiving element even when the light emitting element and the light receiving element are provided so as to face each other with the medium conveyance path in between.

Figure 18:
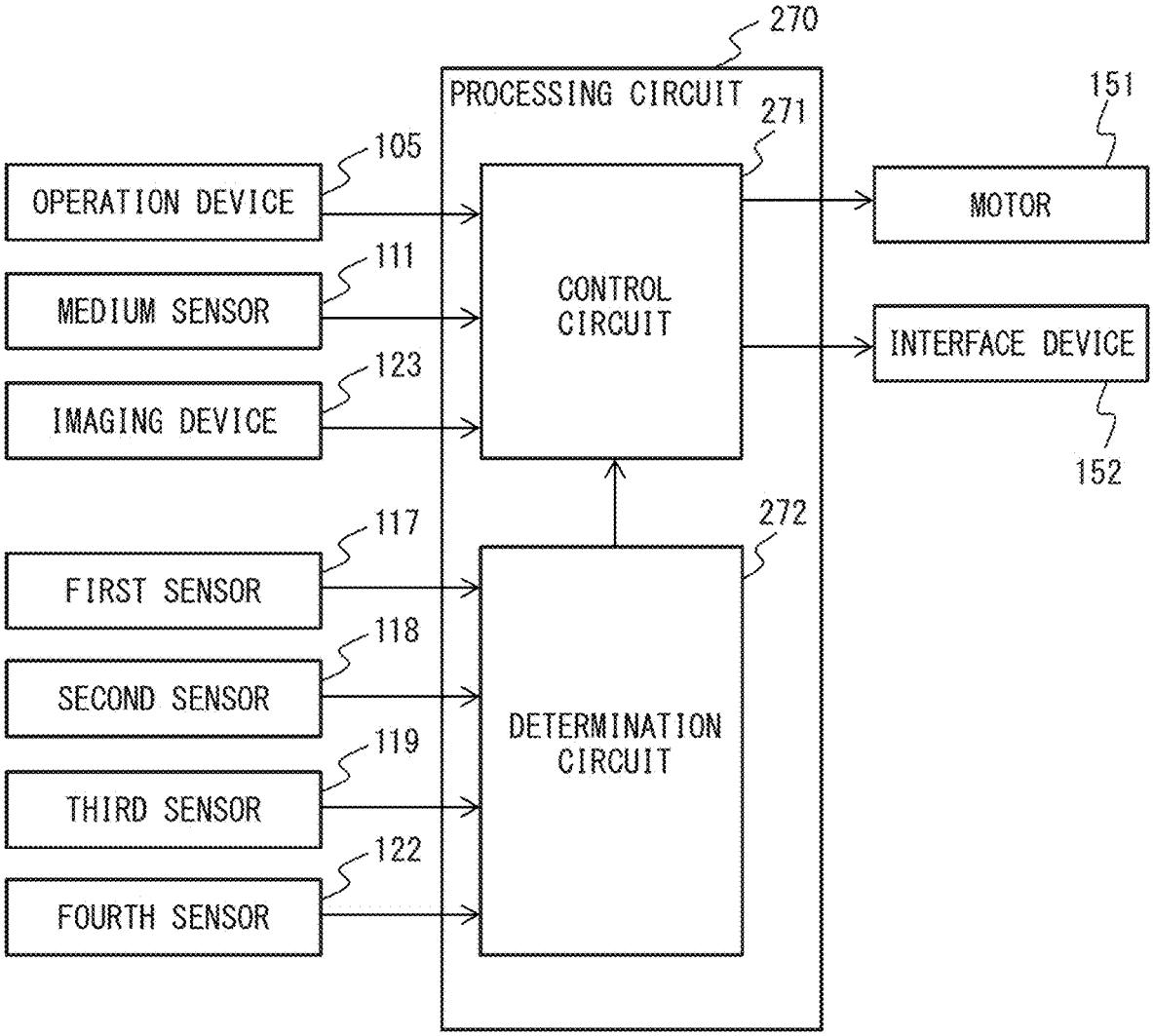
FIG. 18 is a diagram illustrating a schematic configuration of another processing circuit 270.

FIG. 18 is a diagram illustrating a schematic configuration of a processing circuit 270 in a medium conveying apparatus according to yet another embodiment. The processing circuit 270 is used in place of the processing circuit 170 of the medium conveying apparatus 100, and execute a medium reading processing. The processing circuit 270 includes a control circuit 271 and a determination circuit 272, etc. Note that each unit may be configured by an independent integrated circuit, a microprocessor, firmware, etc.

The control circuit 271 is an example of a control module and has a function similar to the control module 171. The control circuit 271 receives the operation signal from the operation device 105, the medium signal from the medium sensor 111, a determination result of the jam and the skew of the medium from the determination circuit 272, and controls the motor 151 based on the received respective signals and the determination result. Further, the control circuit 271 receives the input image from the imaging device 123, and transmits it to the information processing apparatus via the interface device 152 as well as stores it in the storage device 160.

The determination circuit 272 is an example of a determination module and has functions similar to the determination module 172. The determination circuit 272 receives the first optical signal, the second optical signal, the third optical signal and the fourth optical signal from the first sensor 117, the second sensor 118, the third sensor 119 and the fourth sensor 122, respectively. The determination circuit 272 determines whether or not the jam and the skew of the medium has occurred, based on each received optical signal, and outputs the determination result to the control circuit 271.

As described in detail above, the medium conveying apparatus can detect the medium more accurately using the light emitting element and the light receiving element, and appropriately place the light emitting element and the light receiving element, even when using the processing circuit 270.

In the medium conveying apparatus using the light emitting element and the light receiving element for detecting the medium, it is desired to detect the medium more accurately.

According to embodiment, the medium conveying apparatus can detect the medium more accurately using the light emitting element and the light receiving element.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus capable of conveying a passport comprising:

a roller movable according to a thickness of the conveyed passport;

a guide pair including a first guide, and a second guide located to sandwich a medium conveyance path with the first guide there between, to regulate a vertical direction of the medium conveyance path;

a light emitting element located on an outside of the medium conveyance path with one of the first guide or the second guide in between to detect the medium;

a light receiving element located on the outside of the medium conveyance path with the first guide in between, to receive a light emitted by the light emitting element; and an opening provided in the first guide, to pass the light emitted from the light emitting element, wherein the light emitting element, the light receiving element and the opening are located on a downstream side of the roller in a medium conveying direction, wherein the first guide and the second guide are located apart from each other by the thickness of the conveyed passport or more at a position where the light emitting element, the light receiving element and the opening are located in the medium conveying direction, wherein a distance between the first guide and the second guide at a first position is larger than a distance between the first guide and the second guide at a second position on a downstream side of the first position, on an upstream side of the light emitting element and the light receiving element in the medium conveying direction, and wherein a reflectivity in a periphery of the opening of the first guide is 55% or less to absorb a disturbing light entering from a passport conveyance port or a passport discharge port formed by the first guide and the second guide, in the periphery of the opening of the first guide.

2. The medium conveying apparatus according to claim 1, wherein the light emitting element is located on the outside of the medium conveyance path with the first guide in between, and further comprising:

a light guide located on the outside of the medium conveyance path with the second guide in between; and a second guide opening provided in the second guide, to pass the light emitted from the light emitting element, and wherein a reflectivity in a periphery of the second guide opening of the second guide is 55% or less.

3. The medium conveying apparatus according to claim 1, wherein the light emitting element is provided on the outside of the medium conveyance path with the second guide in between.

4. The medium conveying apparatus according to claim 1, wherein the light receiving element is located on a center side with respect to the light emitting element in a width direction perpendicular to the medium conveying direction.

5. The medium conveying apparatus according to claim 1, further comprising a second light emitting element and a second light receiving element to detect the medium using a predetermined opening located apart from the opening in a direction perpendicular to the medium conveying direction.

6. The medium conveying apparatus according to claim 5, further comprising a processor to determine whether a skew of the medium has occurred based on a signal output from the light receiving element and the second light receiving element.

* * * * *